US012035783B2

(12) United States Patent
Bidal et al.

(10) Patent No.: US 12,035,783 B2
(45) **Date of Patent: *Jul. 16, 2024**

(54) GOLF SHOE HAVING COMPOSITE PLATE IN MIDSOLE FOR PROVIDING FLEX AND STABILITY

(71) Applicant: Acushnet Company, Fairhaven, MA (US)

(72) Inventors: Jean-Marie Bidal, Bridgewater, MA (US); John F. Swigart, Portland, OR (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/875,833

(22) Filed: Jul. 28, 2022

(65) Prior Publication Data

US 2022/0361626 A1 Nov. 17, 2022

Related U.S. Application Data

(63) Continuation of application No. 16/576,854, filed on Sep. 20, 2019, now Pat. No. 11,425,959, which is a continuation-in-part of application No. 16/550,516, filed on Aug. 26, 2019, now Pat. No. 11,425,958, which is a continuation-in-part of application No. 29/694,182, filed on Jun. 7, 2019, now Pat. No. Des. 933,347.

(51) Int. Cl.

| | |
|---|---|
| ***A43B 5/00*** | (2022.01) |
| ***A43B 13/02*** | (2022.01) |
| ***A43B 13/12*** | (2006.01) |

(52) U.S. Cl.
CPC ..... *A43B 5/001* (2013.01); *A43B 13/026* (2013.01); *A43B 13/122* (2013.01); *A43B 13/127* (2013.01)

(58) Field of Classification Search
CPC ..... A43B 3/0052; A43B 5/001; A43B 13/122; A43B 13/127; A43C 15/161
USPC ..... 36/107, 127
See application file for complete search history.

(56) References Cited

U.S. PATENT DOCUMENTS

| | | | | |
|---|---|---|---|---|
| 4,372,059 | A | 2/1983 | Ambrose | |
| 4,494,320 | A | 1/1985 | Davis | |
| 4,651,445 | A | 3/1987 | Hannibal | |
| 4,757,620 | A | 7/1988 | Tiitola | |
| 4,798,010 | A | 1/1989 | Sugiyama | |
| 4,858,338 | A * | 8/1989 | Schmid | A43B 13/187 36/102 |
| 5,077,916 | A | 1/1992 | Beneteau | |
| 5,406,723 | A | 4/1995 | Okajima | |

(Continued)

*Primary Examiner* — Sharon M Prange
(74) *Attorney, Agent, or Firm* — Kristin D. Wheeler

(57) ABSTRACT

Golf shoes having improved constructions are provided. The golf shoes include upper, midsole, and outsole sections. The upper may be made of a soft, breathable leather material. The midsole includes an upper region formed from a first material such as a foamed ethylene vinyl acetate (EVA); and a lower region formed from a second material such as a foamed ethylene vinyl acetate (EVA), wherein the materials have different hardness levels. A fiber-reinforced composite plate such as, for example, a carbon fiber plate is disposed in the midsole. The outsole contains different traction members arranged in a precise geometric structure that helps provide improved stability and traction.

17 Claims, 20 Drawing Sheets

(56) References Cited

U.S. PATENT DOCUMENTS

| | | | | |
|---|---|---|---|---|
| 5,943,794 | A | 8/1999 | Gelsomini | |
| 6,389,713 | B1 * | 5/2002 | Kita | A43B 13/18 36/31 |
| 6,425,193 | B2 | 7/2002 | Vaz | |
| 6,725,574 | B2 | 4/2004 | Hokkirigawa et al. | |
| 6,775,930 | B2 * | 8/2004 | Fuerst | A43B 13/026 12/146 B |
| 7,096,605 | B1 | 8/2006 | Koza | |
| 7,401,421 | B2 | 7/2008 | Brennan | |
| 7,487,604 | B2 | 2/2009 | Perron, Jr. | |
| 7,627,961 | B2 * | 12/2009 | Brewer | A43B 7/088 36/28 |
| 7,832,117 | B2 | 11/2010 | Auger et al. | |
| 7,886,460 | B2 | 2/2011 | Teteriatnikov | |
| 8,176,659 | B2 | 5/2012 | Von Blucher | |
| 8,813,390 | B2 | 8/2014 | Auger et al. | |
| 9,370,904 | B2 | 6/2016 | Khan | |
| 9,826,797 | B2 | 11/2017 | Elder | |
| 10,743,612 | B2 | 8/2020 | Iuchi | |
| 2004/0107601 | A1 | 6/2004 | Schmid | |
| 2006/0021257 | A1 | 2/2006 | Hung | |
| 2010/0263234 | A1 | 10/2010 | Teteriatnikov | |
| 2013/0326908 | A1 | 12/2013 | Grott et al. | |
| 2016/0021977 | A1 * | 1/2016 | Madore | A43B 13/42 36/30 R |
| 2016/0312398 | A1 | 10/2016 | Simmons et al. | |
| 2016/0361909 | A1 | 12/2016 | Simmons et al. | |
| 2017/0095034 | A1 * | 4/2017 | Dupre | A43B 7/148 |
| 2017/0157893 | A1 | 6/2017 | Simmons et al. | |
| 2017/0340060 | A1 * | 11/2017 | Madore | A43B 13/04 |

* cited by examiner

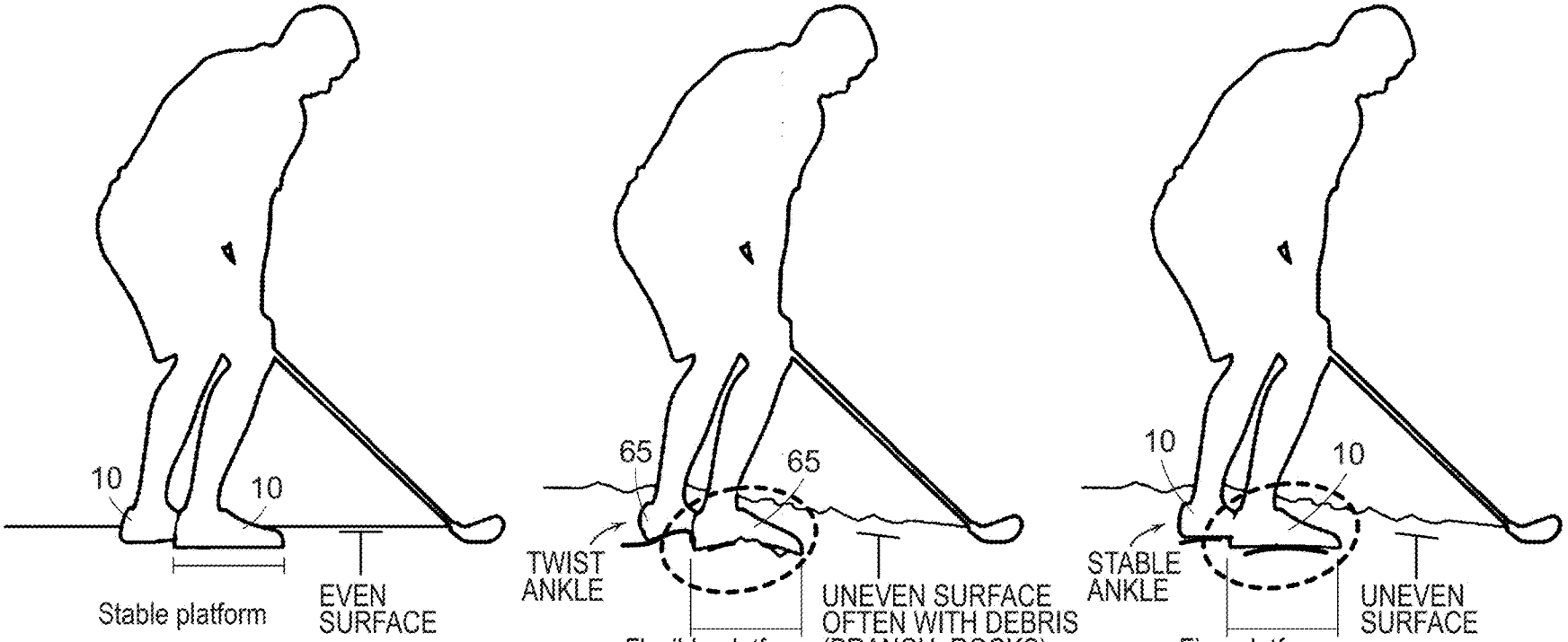
FIG. 10A
FIG. 10B
(Prior Art)
FIG. 10D
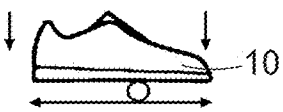
(Prior Art)
FIG. 10C
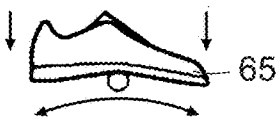
FIG. 10E

A-A'

B-B'

C-C'

D-D'

Diagram I

Diagram II

GOLF SHOE HAVING COMPOSITE PLATE IN MIDSOLE FOR PROVIDING FLEX AND STABILITY

CROSS-REFERENCE TO RELATED APPLICATIONS

This application is a continuation of co-pending, co-assigned U.S. patent application Ser. No. 16/576,854, filed on Sep. 20, 2019, which is a continuation-in-part of co-pending, co-assigned U.S. patent application Ser. No. 16/550,516, filed on Aug. 26, 2019, which is a continuation-in-part of co-assigned U.S. patent application Ser. No. 29/694,182, filed on Jun. 7, 2019, now U.S. Design Pat. No. D933,347, the entire disclosures of which are incorporated by reference herein.

BACKGROUND OF THE INVENTION

Field of the Invention

The present invention relates generally to shoes and more particularly to golf shoes having good flexibility, stability, and traction. The midsole is preferably made of two foam materials having different properties. The outsole contains multiple traction members and has a geometric structure that provides high traction and ground contact.

Brief Review of the Related Art

Both professional and amateur golfers use specially designed golf shoes today. Typically, the golf shoe includes an upper portion and outsole portion along with a mid-sole connecting the upper to the outsole. The upper has a traditional shape for inserting a user's foot and thus covers and protects the foot in the shoe. The upper is designed to provide a comfortable fit around the contour of the foot. The mid-sole is relatively lightweight and provides cushioning to the shoe. The outsole is designed to provide stability and traction for the golfer. The bottom surface of the outsole may include spikes or cleats designed to engage the ground surface through contact with and penetration of the ground. These elements help provide the golfer with better foot stability and traction as he/she walks and plays the course.

Often, the terms, "spikes" and "cleats" are used interchangeably in the golf industry. Some golfers prefer the term, "spikes," since cleats are more commonly associated with other sports such as baseball, football, and soccer. Other golfers like to use the term, "cleats" since spikes are more commonly associated with non-turf sports such as track or bicycling. In the following description, the term, "spikes" will be used for convenience purposes. Golf shoe spikes can be made of a metal or plastic material. However, one problem with metal spikes is they are normally elongated pieces with a sharp point extending downwardly that can break through the surface of the putting green thereby leaving holes and causing other damage. These metal spikes also can cause damage to other ground surfaces at a golf course, for example, the carpeting and flooring in a clubhouse. Today, most golf courses require that golfers use non-metal spikes. Plastic spikes normally have a rounded base having a central stud on one face. On the other face of the rounded base, there are radial arms with traction projections for contacting the ground surface. Screw threads are spaced about the stud on the spike for inserting into a threaded receptacle on the outsole of the shoe as discussed further below. These plastic spikes, which can be easily fastened and later removed from the locking receptacle on the outsole, tend to cause less damage to the greens and clubhouse flooring surfaces.

If spikes are present on the golf shoe, they are preferably detachably fastened to receptacles (sockets) in the outsole. The receptacles may be located in a molded pod attached to the outsole. The molded pods help provide further stability and balance to the shoe. The spike may be inserted and removed easily from the receptacle. Normally, the spike may be secured in the receptacle by inserting it and then slightly twisting it in a clockwise direction. The spike may be removed from the receptacle by slightly twisting it in a counter-clockwise direction.

In recent years, "spikeless" or "cleatless" shoes have become more popular. These shoe outsoles contain rubber or plastic traction members but no spikes or cleats. These traction members protrude from the bottom surface of the outsole to contact the ground.

When a golfer swings a club and transfers his/her weight, their foot absorbs tremendous forces. For example, when a right-handed golfer is first planting his/her feet before beginning any club swinging motion (that is, when addressing the ball), their weight is evenly distributed between their front and back feet. As the golfer begins their backswing, their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing and drives the ball, their weight is transferred from the driving foot to the front (stabilizing) foot. During the swinging motion, there is some pivoting at the back and front feet, but this pivoting motion must be controlled. It is important the feet do not substantially move or slip when making the shot. Good foot traction is important during the golf shot cycle. It is important that the shoes provide good stability. The golfer needs a stable platform so that he/she can maintain their balance as they perform their swinging action. Manufacturers of golf shoes have looked at different ways for improving the stability of golf shoes. For example, manufacturers have looked at positioning traction members and spikes at different locations across the outsole.

Golf shoe manufacturers have developed shoes with different spikes for providing traction and stability for the golfer. For example, Dalton U.S. Pat. No. 6,161,315 discloses an outsole having forefoot, shank, and heel sections. A stability ridge is disposed on the outer surface and along the perimeter of the forefoot and heel. According to the '315 Patent, this outer ridge provides twisting traction and stability without adversely affecting the golfer's swing. The ridge may include one or more spikes.

Campbell et al., U.S. Pat. No. 8,082,686 discloses a cleated shoe that provides cushion support and lateral stability. The shoe includes a lower and an upper. The lower may include a primary midsole, cushion elements, and an outsole. A cleat may be connected to the outsole. At least one cushion may be located between the primary midsole and outsole.

Bacon et al., U.S. Pat. No. 8,677,657 discloses a golf shoe having an outsole with multiple pod sections molded to its bottom surface. Each pod section contains a receptacle for holding a removable cleat (spike). Preferably, there are eight separate pod sections. The pod sections have a flared outer perimeter extending beyond the normal contour of the outsole. According to the '657 Patent, these pods with their spikes and exterior outer surfaces, which are flared away from the normal contour of the outsole, help provide greater stability and support during the golf swing.

Rushbrook et al., U.S. Pat. No. 9,609,915 discloses an outsole with spikes and flex zones that allow relative movement between regions of the outsole bottom surface that are separated by the flex zones. According to the '915 Patent, such relative movement, together with spikes, help provide traction and stability for the golfer.

However, one drawback with some conventional golf shoes is these shoes may help provide the golfer with good stability and traction, but there is a loss in shoe flexibility. Some traditional golf shoes are relatively stiff—they provide a rigid platform, but they do not provide the needed flexibility for golfers. As discussed further below, when a golfer swings a club and transfers his/her weight on their feet, there are high forces placed on the foot. The shoe needs to provide a stable platform for the golfer when he/she maker their swing, but the foot also needs to be able to flex to a certain degree. The bending of the shoe also is important when the golfer is walking the course, crouching down to line-up a putt, and other golfing actions.

Thus, there is a need for a golf shoe that can provide a high level of stability and traction and yet also provide high flexibility. The shoe should hold and support the medial and lateral sides of the golfer's foot as they shift their weight while making a golf shot. The shoe should provide good stability and traction so there is no slipping and the golfer can stay balanced as he/she swings the club. At the same time, the shoe should also have good flexibility. A golfer wearing the shoe should be able to walk and play the course and engage in other golf activities comfortably. The present invention provides new golf shoe constructions that provide high stability and traction as well as flexibility for the golfer and has other advantageous properties and features.

SUMMARY OF THE INVENTION

The present invention provides a golf shoe comprising: an upper; and outsole; and a midsole connected to the upper and outsole. The upper; midsole; and outsole each have forefoot, mid-foot, and rear-foot regions with lateral and medial sides. In particular, the midsole comprises: i) an upper region formed from a first material; and ii) a lower region formed from a second material, and iii) a fiber-reinforced composite plate disposed between the upper and lower regions, wherein the second material has a Shore C hardness greater than the first material's Shore C hardness.

The composite plate extends from the anterior region to posterior region of the midsole. In one embodiment, the composite plate is positioned so that it has a first end in the forefoot region of the midsole and a second end in the rear-foot region of the midsole, wherein the distance from the first end of the composite plate to the forefoot region is less than the distance from the second end of the composite plate to the rear-foot region. In one example, carbon fiber such as graphite is used as reinforcing fibers in the composite plate. Other fibers such as aramids (for example, Kevlar™), aluminum, or glass fibers can be used in addition to or in place of the carbon fibers.

The second material used to form the lower region of the midsole can have, for example, a hardness in the range of about 45 to about 80 Shore C; and the first material used to form the upper region of the midsole can have, for example, a hardness in the range of about 40 to about 75 Shore C. Different ethylene vinyl acetate copolymer (EVA) foam compositions can be used to form the lower and upper regions of the midsole. Other suitable materials include polyurethane foam compositions.

The outsole comprises a first Track A containing a first set of traction members; and a second Track B containing a second set of traction members, wherein Track A extends from the periphery of the medial side of the forefoot and through the mid-foot region to the periphery of the lateral side of the rear-foot region. Meanwhile, Track B extends from the periphery of the lateral side of the forefoot and through the mid-foot region to the periphery of the medial side of the rear-foot region such that Tracks A and B criss-cross each other in the mid-foot region. Tracks A and B can be formed of any suitable material such as, for example, EVA and polyurethane foam compositions.

The first set of traction members of Track A can project outwardly from a plurality of first traction member bases that are fastened to Track A. The second set of traction members of Track B can project outwardly from a plurality of first traction member bases that are fastened to Track B. The respective traction member bases can be fastened to Tracks A and B by stitching, adhesives, or any other suitable fastening means. The traction members and the bases for the traction members can be made of any suitable material such as, for example, thermoplastic polyurethanes. The traction members and their respective bases can have various shapes such as, for example, annular, rectangular, triangular, square, spherical, elliptical, star, diamond, pyramid, arrow, conical, blade-like, and rod shapes. The traction members of Track A and the traction members of Track B can have the same or different shapes. In one preferred embodiment, at least a portion of the traction members of Track A and at least a portion of the traction members of Track B have conical shapes.

In one embodiment, the outsole further comprises first and second sets of stability traction ridges, wherein the ridges are located in a central area between Tracks A and B, the first set being located in the forefoot region and the second set being located in the rear-foot region. In one embodiment, the outsole further comprises a set of mid-foot stability traction pieces, the first piece being disposed on the lateral side of the mid-foot region and the second piece being disposed on the medial side of the mid-foot region. A third set of traction members project outwardly from the first stability piece and a fourth set of traction members project outwardly from the second stability piece. The traction members and stability pieces can be made from thermoplastic polyurethanes.

The shoes of this invention have many advantageous features. The shoes provide good stability and traction so there is no slipping and the golfer can stay balanced as he/she swings the club. At the same time, the shoes also have good forefoot flexibility. A golfer can walk and play the course naturally and freely.

BRIEF DESCRIPTION OF THE FIGURES

The novel features that are characteristic of the present invention are set forth in the appended claims. However, the preferred embodiments of the invention, together with further objects and attendant advantages, are best understood by reference to the following detailed description in connection with the accompanying drawings in which:

FIG. 10A is a schematic diagram of a golfer wearing one example of the golf shoes of the invention on a generally level surface of a golf course such as the Fairway;

FIG. 10B is a schematic diagram of a golfer wearing one example of golf shoes of the prior art on a generally non-level surface of a golf course such as the Rough;

FIG. 10C is a close-up view of the golf shoe shown in FIG. 10B;

FIG. 10D is a schematic diagram of a golfer wearing one example of the golf shoes of this invention on a generally non-level surface of a golf course such as the Rough;

FIG. 10E is a close-up view of the golf shoe shown in FIG. 10D;

DETAILED DESCRIPTION OF THE INVENTION

Figure 1:
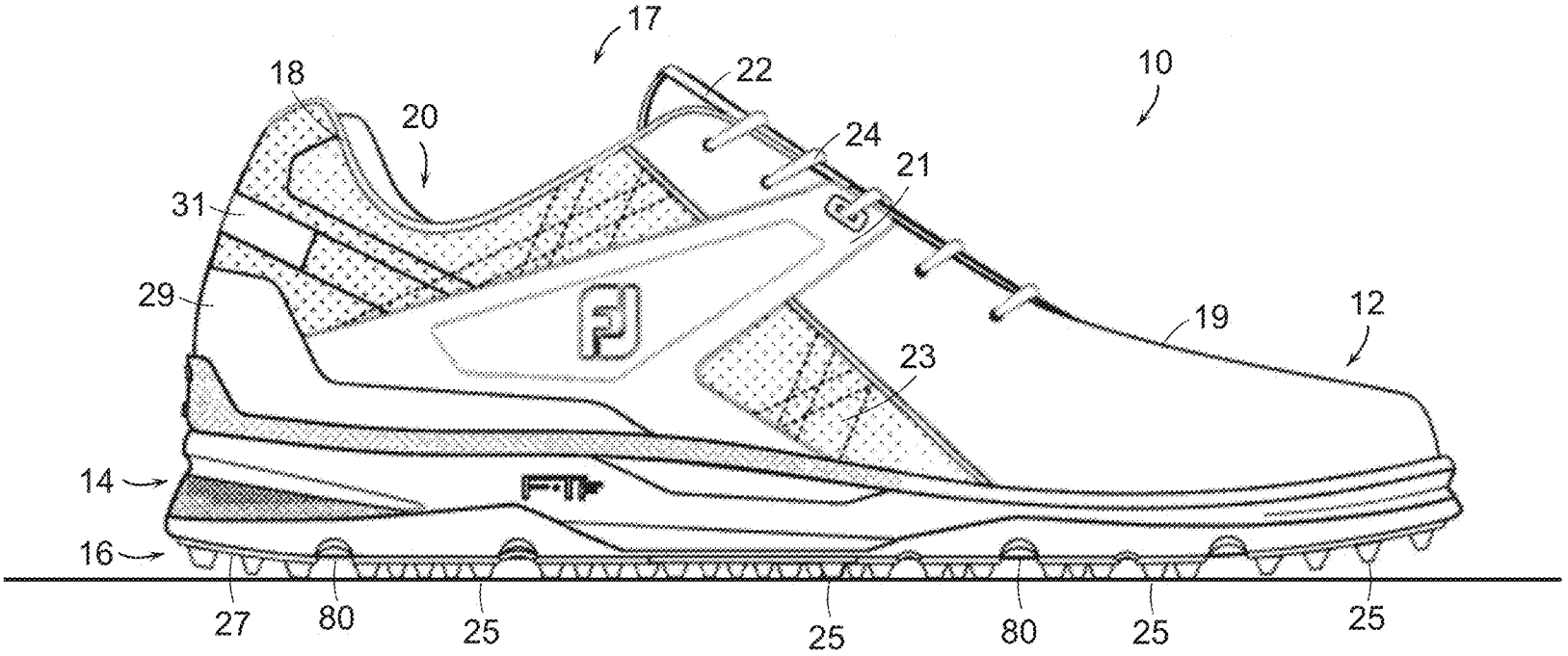
FIG. 1 is a perspective view of one example of a golf shoe of the present invention showing the upper portion in detail.
Figure 2:
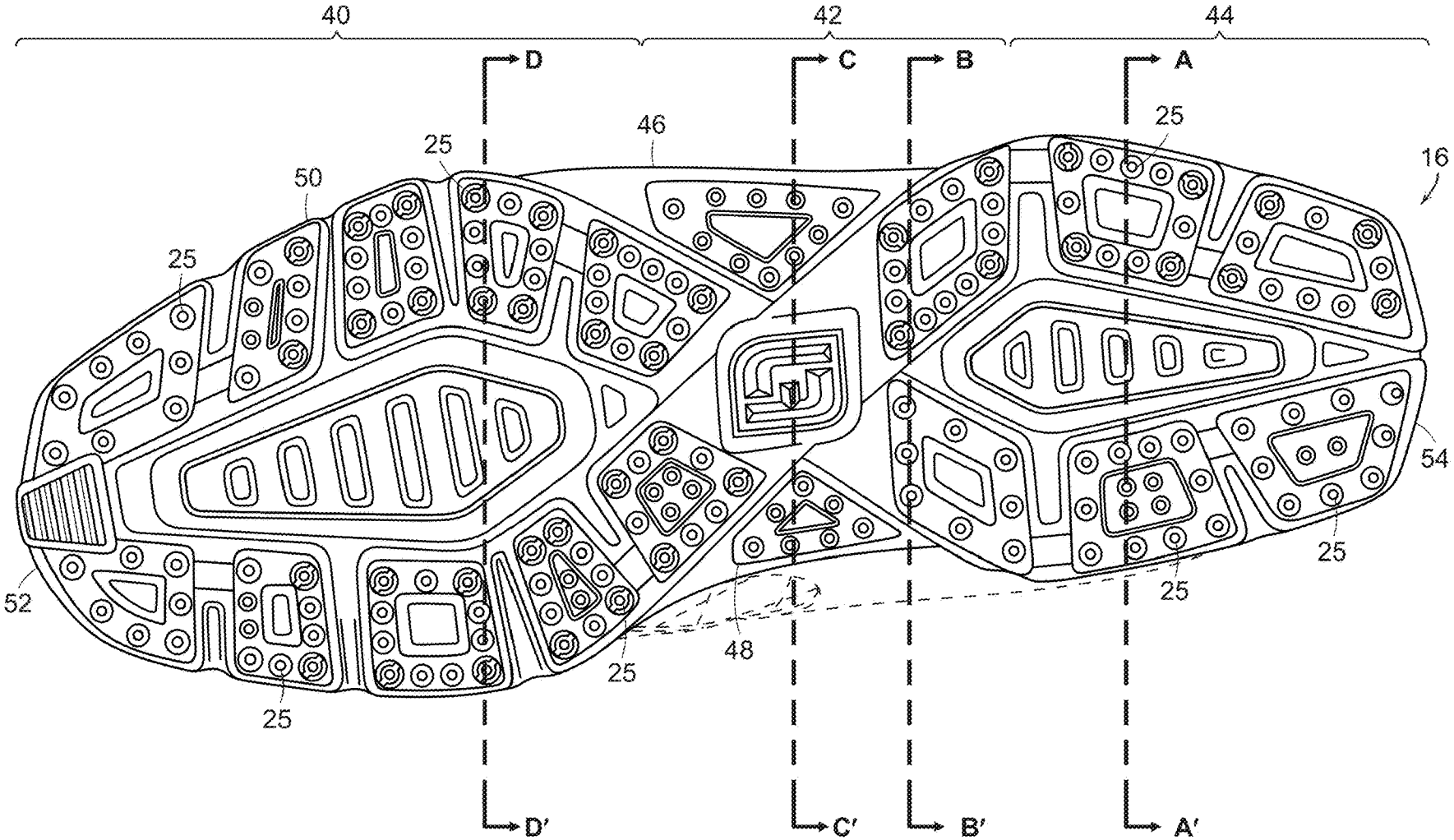
FIG. 2 is a bottom plan view of one example of a golf shoe of the present invention showing the outsole portion in detail.
Figure 3:
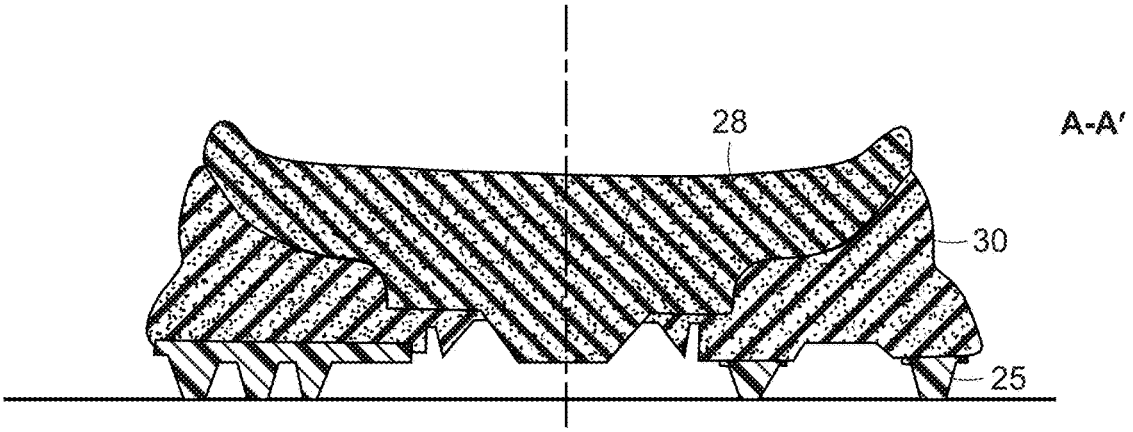
FIG. 3 is a cross-sectional view of the golf shoe in FIG. 2 along Line A-A'.
Figure 4:
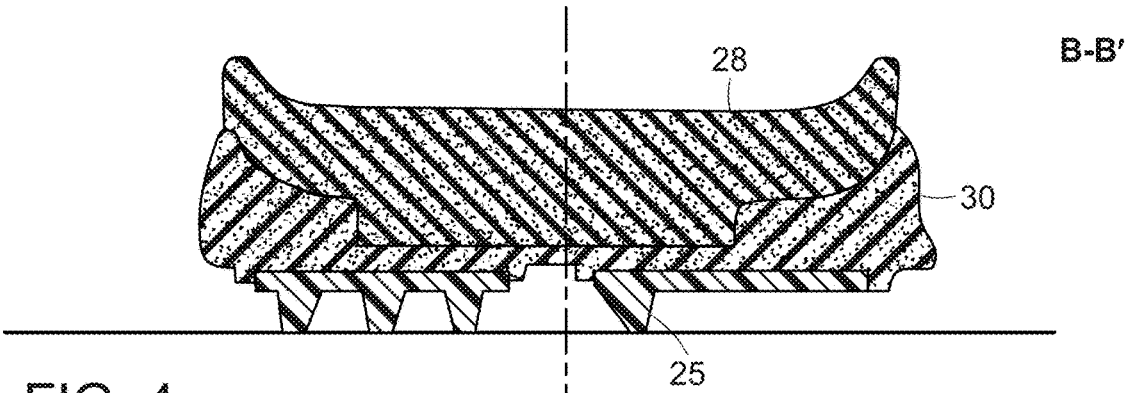
FIG. 4 is a cross-sectional view of the golf shoe in FIG. 2 along Line B-B'.
Figure 5:
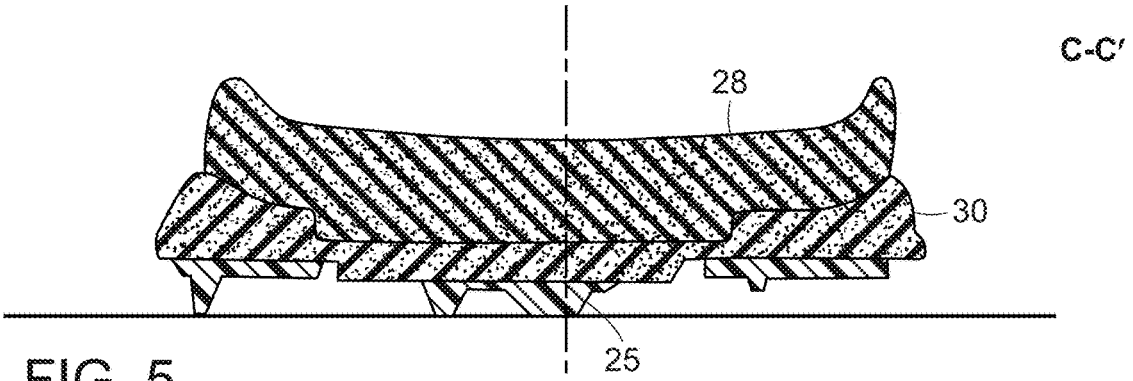
FIG. 5 is a cross-sectional view of the golf shoe in FIG. 2 along Line C-C'.
Figure 6:
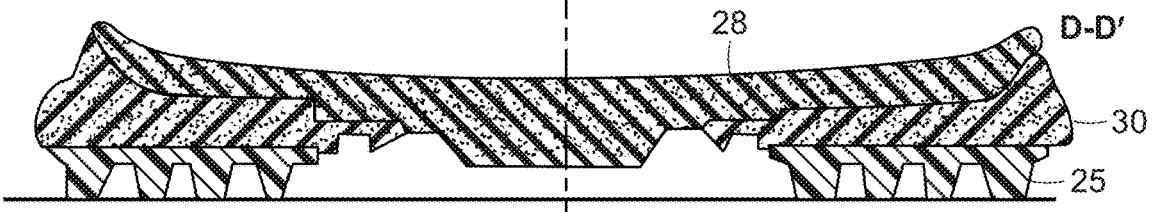
FIG. 6 is a cross-sectional view of the golf shoe in FIG. 2 along Line D-D'.

Referring to the Figures, where like reference numerals are used to designate like elements, and particularly FIG. 1, one embodiment of the golf shoe (10) of this invention is shown. The shoe (10) includes an upper portion (12) and outsole portion (16) along with a midsole (14) connecting the upper (12) to the outsole (16). The midsole (14) is joined to the upper (12) and outsole (16) as discussed in more detail below. The views shown in the Figures are of right and left shoes and it is understood the components for these respective shoes will be mirror images of each other. It also should be understood that the shoe may be made in various sizes, and thus the size of the components of the shoe may be adjusted depending upon shoe size.

The upper (12) has a traditional shape and is made from a standard upper material such as, for example, natural leather, synthetic leather, non-woven materials, natural fabrics, and synthetic fabrics. For example, breathable mesh, and synthetic textile fabrics made from nylons, polyesters, polyolefins, polyurethanes, rubbers, and combinations thereof can be used. The material used to construct the upper is selected based on desired properties such as breathability, durability, flexibility, and comfort. In one preferred example, the upper (12) is made of a soft, breathable leather material having waterproof properties. The upper material is stitched or bonded together to form an upper structure using traditional manufacturing methods. Referring to FIG. 1, the upper (12) generally includes an instep region (17) with an opening (20) for inserting a foot. The upper (12) preferably includes a soft, molded foam heel collar (18) for providing enhanced comfort and fit. An optional ghille strip (31) is wrapped around the heel collar. The upper includes a vamp (19) for covering the forepart of the foot. The instep region includes a tongue member (22) and a power harness (21) overlying the quarter section (23) of the upper and attached to the foxing (29) in the heel region. The power harness (21) can be used to help with medial control and support of the foot. Normally, laces (24) are used for tightening the shoe around the contour of the foot. However, other tightening systems can be used including metal cable (lace)-tightening assemblies that include a dial, spool, and housing and locking mechanism for locking the cable in place. Such lace tightening assemblies are available from Boa Technology, Inc., Denver, CO 80216. It should be understood that the above-described upper (12) shown in FIG. 1 represents only one example of an upper design that can be used in the shoe construction of this invention and other upper designs can be used without departing from the spirit and scope of this invention.

The midsole (14) is relatively lightweight and provides cushioning to the shoe. The midsole (14) can be made from midsole materials such as, for example, foamed ethylene vinyl acetate copolymer (EVA) or foamed polyurethane compositions. In one preferred embodiment, the midsole (14) is constructed using two different foamed materials as described below.

Referring to FIGS. 2-6, the midsole (14) generally includes two regions: a) an upper (interior) region (28); and b) a lower (exterior) region (30). In one preferred embodiment, the upper region (28) is made of a relatively soft and flexible material. For example, the upper region (28) may be made of a relatively soft first EVA foam composition having a hardness ranging from about 40 to about 75 Shore C. In one particular example, the relatively soft first EVA foam composition has a Shore C hardness in the range of about 50 to about 70. In one preferred embodiment, the relatively soft first EVA foam composition has a hardness in the range of about 55 to about 60 Shore C. Meanwhile, the lower region (30) is preferably made of a relatively firm material such as a second EVA foam composition. In one embodiment, a blend of EVA and styrenic block copolymer rubber (such as "SI", "SIS", "SB", "SBS", "SIBS", "SEBS", "SEPS" and the like, where "S" is styrene, "I" is isobutylene, "E" is ethylene, "P" is propylene, and "B" is butadiene), can be used to form the relatively firm second EVA foam composition. The hardness of the lower region (30) is preferably greater than the hardness of the upper region (28). For example, the lower region (30) may be made of a relatively firm second EVA foam composition having a hardness ranging from about 45 to about 80 Shore C. In one particular example, the relatively firm second EVA foam composition has a Shore C hardness in the range of about 50 to about 75. In one preferred embodiment, the relatively firm second EVA foam composition has a hardness in the range of about 65 to about 70 Shore C. For example, the hardness of the foamed lower region (30) can be at least 5% greater than the hardness of the foamed upper region (28). In some embodiments, the hardness of the foamed lower region (30) can be at least 10% or 15% greater; and in other embodiments, at least 20% or 25% greater. The densities of the first foamed composition and second foamed composition also are preferably different. For example, the density of the relatively firm second EVA foamed composition, which is used to form the lower region (30), is preferably greater than the density of the relatively soft first EVA foamed composition, which is used to form the upper region (28).

As discussed above, the EVA foam compositions are preferably used to form the midsole. Different foaming additives and catalysts are used to produce the EVA foam. For example, the EVA foam composition normally contains polyethylene. The EVA foam compositions have various properties making them particularly suitable for constructing midsoles including good cushioning and shock absorption; high water and moisture-resistance; and long-term durability.

Figure 7:
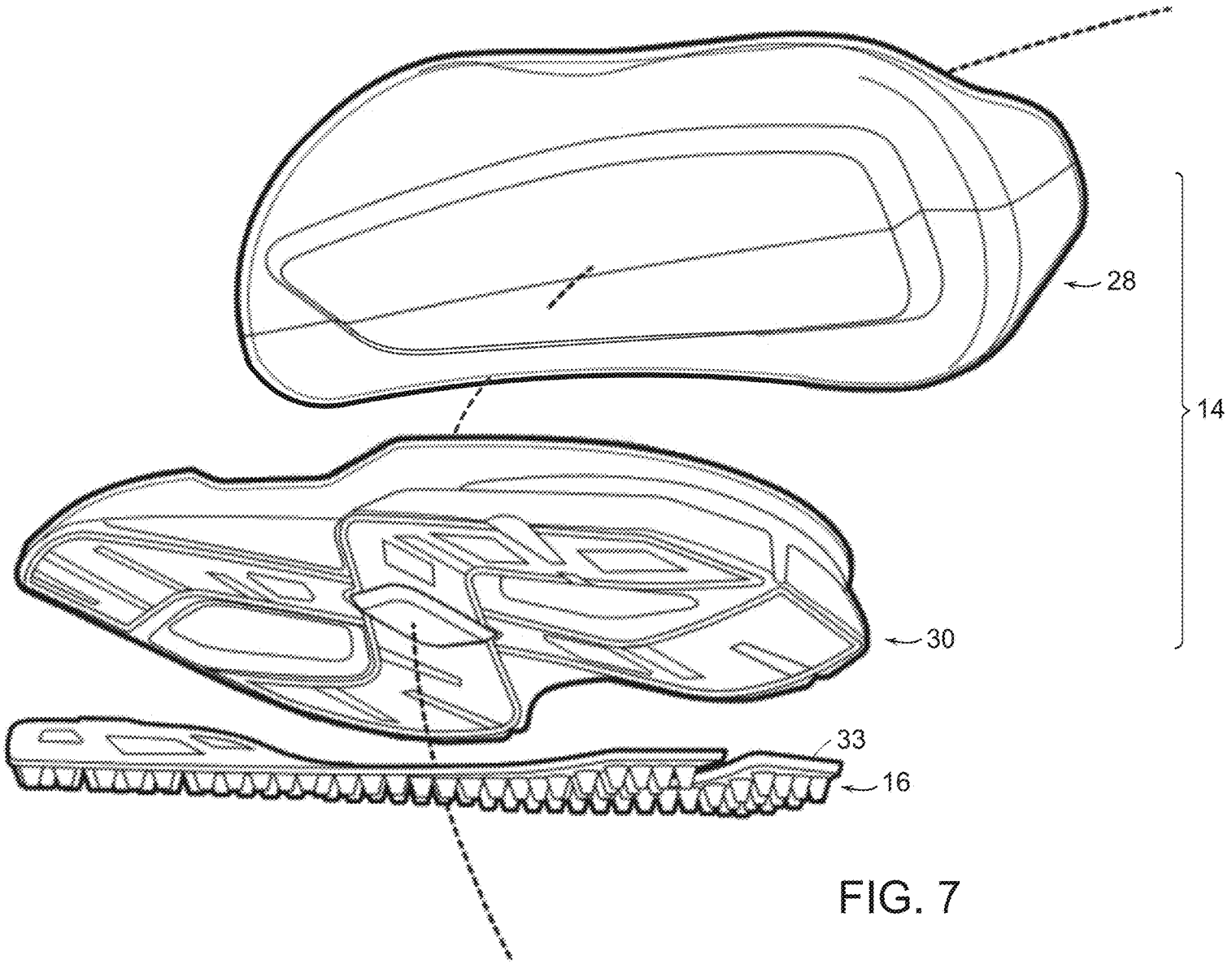
FIG. 7 is an exploded view of one example of a midsole and outsole of the golf shoe of the present invention showing the different components of the midsole and outsole in detail.

Referring to FIG. 7, the upper and lower regions (28, 30) of the midsole (14) are shown in an exploded view. In one manufacturing process, the midsole (14) can be molded as a separate piece and then joined to the top surface (33) of the outsole (16) by stitching, adhesives, or other suitable means using standard techniques known in the art. For example, the midsole (14) can be heat-pressed and bonded to the top surface (33) of the outsole (16). The midsole (14) can be molded using a 'two-shot' molding method.

Referring to the outsole (16), this part is designed to primarily provide support and traction for the shoe. The bottom surface (27) of the outsole (16) includes multiple traction members that are generally indicated at (25) in FIG. 1. The traction members (25) help provide traction between the shoe and the different surfaces of a golf course. The traction members (25) can be made of any suitable material such as rubbers, plastics, and combinations thereof. Thermoplastics such as nylons, polyesters, polyolefins, and polyurethanes can be used. In one preferred embodiment, the traction members are made of a relatively hard thermoplastic polyurethane composition. Different polyamide compositions including polyamide copolymers and aramids also can be used to form the traction members. For example, Pebax® elastomers (available from Arkema), which are block copolymers of rigid polyamide blocks and soft polyether blocks, can be used. Suitable rubber materials include, but are not limited to, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, nitrile rubber, and blends of two or more thereof. The structure and geometry of the different traction members (25) and the outsole (16) of the present invention are described in further detail below.

In general, the anatomy of the foot can be divided into three bony regions. The rear-foot region generally includes the ankle (talus) and heel (calcaneus) bones. The mid-foot region includes the cuboid, cuneiform, and navicular bones that form the longitudinal arch of the foot. The forefoot region includes the metatarsals and the toes. As shown in FIG. 1, the outsole (16) has a top surface (not shown) and bottom surface (27). The midsole (14) is joined to the top surface of the outsole (16). The upper (12) is joined to the midsole (14).

Referring back to FIG. 2, the outsole (16) generally includes a forefoot region (40) for supporting the forefoot area; a mid-foot region (42) for supporting the mid-foot including the arch area; and rearward region (44) for supporting the rear-foot including heel area. In general, the forefoot region (40) includes portions of the outsole corresponding with the toes and the joints connecting the metatarsals with the phalanges. The mid-foot region (42) generally includes portions of the outsole corresponding with the arch area of the foot. The rear-foot region (44) generally includes portions of the outsole corresponding with rear portions of the foot, including the calcaneus bone.

The outsole (16) also includes a lateral side (46) and a medial side (48). Lateral side (46) and medial side (48) extend through each of the foot regions (40, 42, and 44) and correspond with opposite sides of the outsole. The lateral side or edge (46) of the outsole is the side that corresponds with the outer area of the foot of the wearer. The lateral edge (46) is the side of the foot of the wearer that is generally farthest from the other foot of the wearer (that is, it is the side closer to the fifth toe [little toe].) The medial side or edge (48) of the outsole is the side that corresponds with the inside area of the foot of the wearer. The medial edge (48) is the side of the foot of the wearer that is generally closest to the other foot of the wearer (that is, the side closer to the hallux [big toe].) More particularly, the lateral and medial sides extend around the periphery or perimeter (50) of the outsole (16) from the anterior end (52) to the posterior end (54) of the outsole. The anterior end (52) is the portion of the outsole corresponding to the toe area, and the posterior end (54) is the portion corresponding to the heel area. The regions, sides, and areas of the outsole as described above are not intended to demarcate precise areas of the outsole. Rather, these regions, sides, and areas are intended to represent general areas of the outsole. The upper (12) and midsole (14) also have such regions, sides, and areas. Each region, side, and area also may include anterior and posterior sections.

Forefoot Region

Referring back to FIG. 1, the traction members (25) protrude from the bottom surface (27) of the outsole (16) in the forefoot (40) region to contact the ground. The traction members (25) help provide good stability and traction for the golfer when he/she is walking and playing the course as discussed above. The protruding traction members (25) extend along the length of the outsole (16) and are found in the forefoot, mid-foot, and rear-foot regions (40, 42, and 44).

The outsole (16) can contain a wide variety of traction members (25) so that the traction and gripping power for the different golf course surfaces are maximized and less damage is done to that surface for the amount of traction provided. The traction members (25) can have many different shapes including for example, but not limited to, annular, rectangular, triangular, square, spherical, elliptical, star, diamond, pyramid, arrow, conical, blade-like, and rod shapes. Also, the height and area of the different traction members (25) can be adjusted as needed. In one preferred embodiment, the golf shoe of this invention has five different traction members (25) extending along the length of the outsole (16), and these traction members are discussed in further detail below.

Along with traction, the forefoot, mid-foot, and rear-foot regions (40, 42, and 44) of the golf shoe (10) are important for providing stability and comfort for the foot. For instance, many golf courses offer golfers the choice of driving an electric-powered cart over or walking the course. Some golfers prefer to walk the entire course. Even golfers, who prefer to drive carts, will walk a considerable distance during their round of play. Depending upon the length of the course, speed of play, and other factors, a golfer may walk a few miles in a round. Thus, a golf shoe needs to be comfortable to wear and allow a golfer to walk naturally and freely. That is, the shoe needs to support the foot and yet it also needs to be flexible. The golfer must be able to address the ball, make a swing, walk comfortably on the course, and do other golf-specific actions such as crouching down to line-up a putt. There are two key directions of foot movement that must be considered: 1) dorsiflexion, and 2) plantar flexion. In general, dorsiflexion is the action of raising the foot (60) upwards toward the shin. That is, the foot (60) is flexing in the dorsal or upward direction. The muscles and tendons located in the front of the foot and leg that are passed into the ankle joint are used to move the foot in the dorsiflexion direction. In general, the foot (60) moves upwards in the range of about 10 to about 30 degrees. On the other hand, plantar flexion is the action of moving the foot (60) in a downward direction towards the ground. The muscles and tendons located in the back and inside of the foot and leg that are passed into the ankle joint are used to move the foot in the plantar flexion direction. In general, the foot (60) moves upwards in the range of about 20 to about 50 degrees.

Figure 8A:
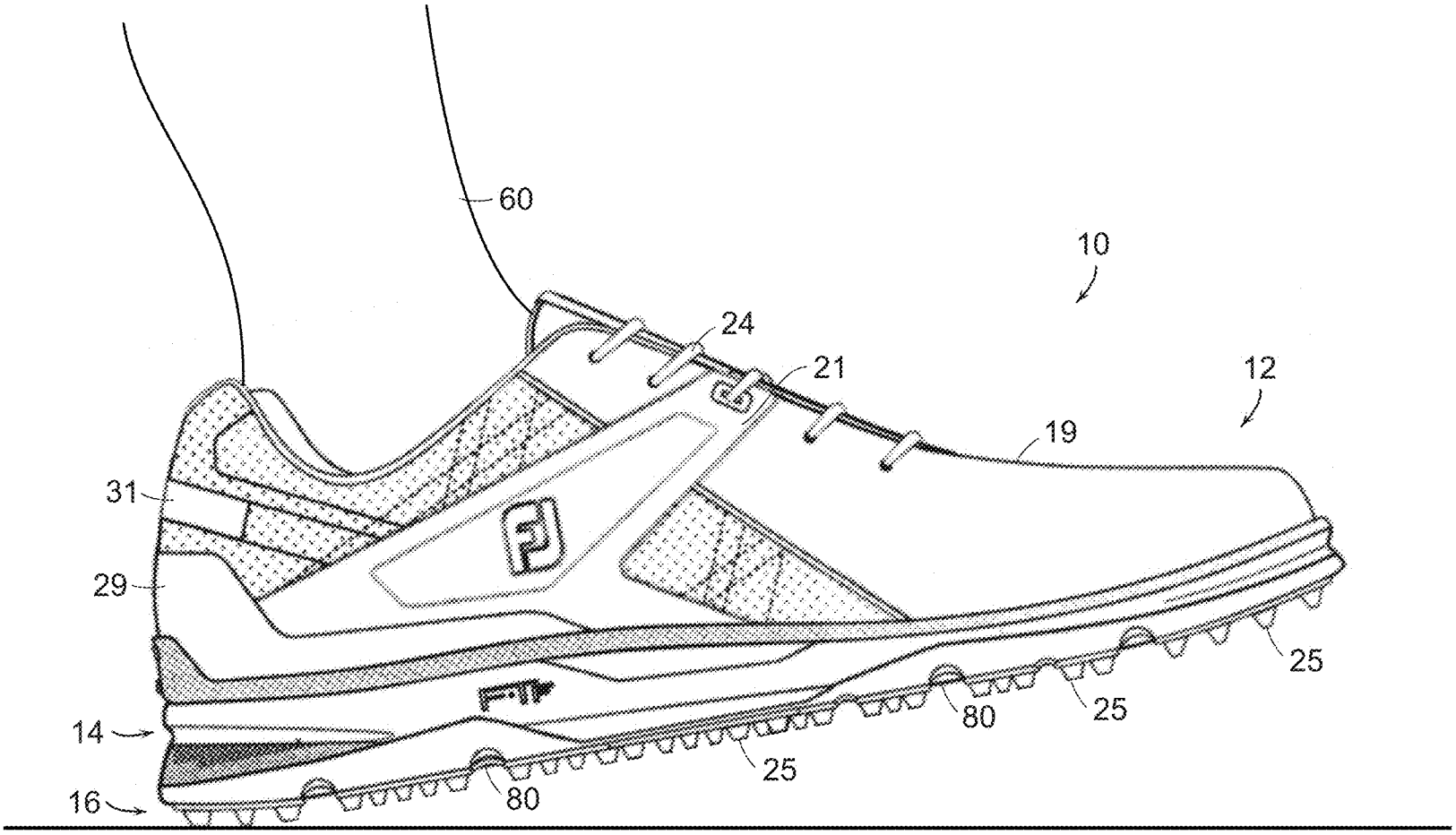
FIG. 8A is a lateral view of one example of the golf shoe of the present invention showing the rearward portion of the outsole striking the ground surface during a first stage of a person's walking cycle.
Figure 8B:
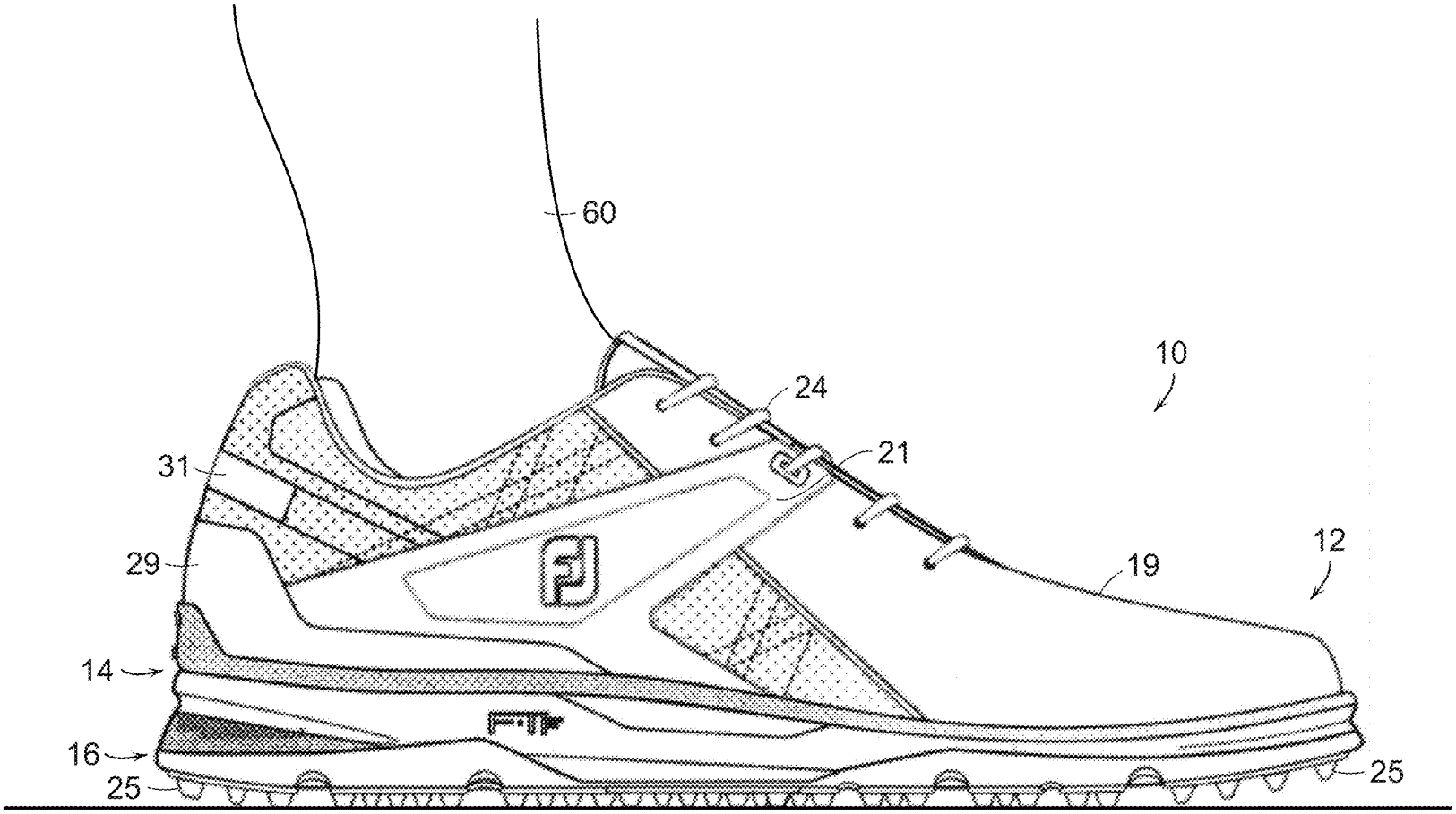
FIG. 8B is a lateral view of the golf shoe in FIG. 8A showing the rearward and forward portion of the outsole making contact with the ground surface during a second stage of a person's walking cycle.
Figure 8C:
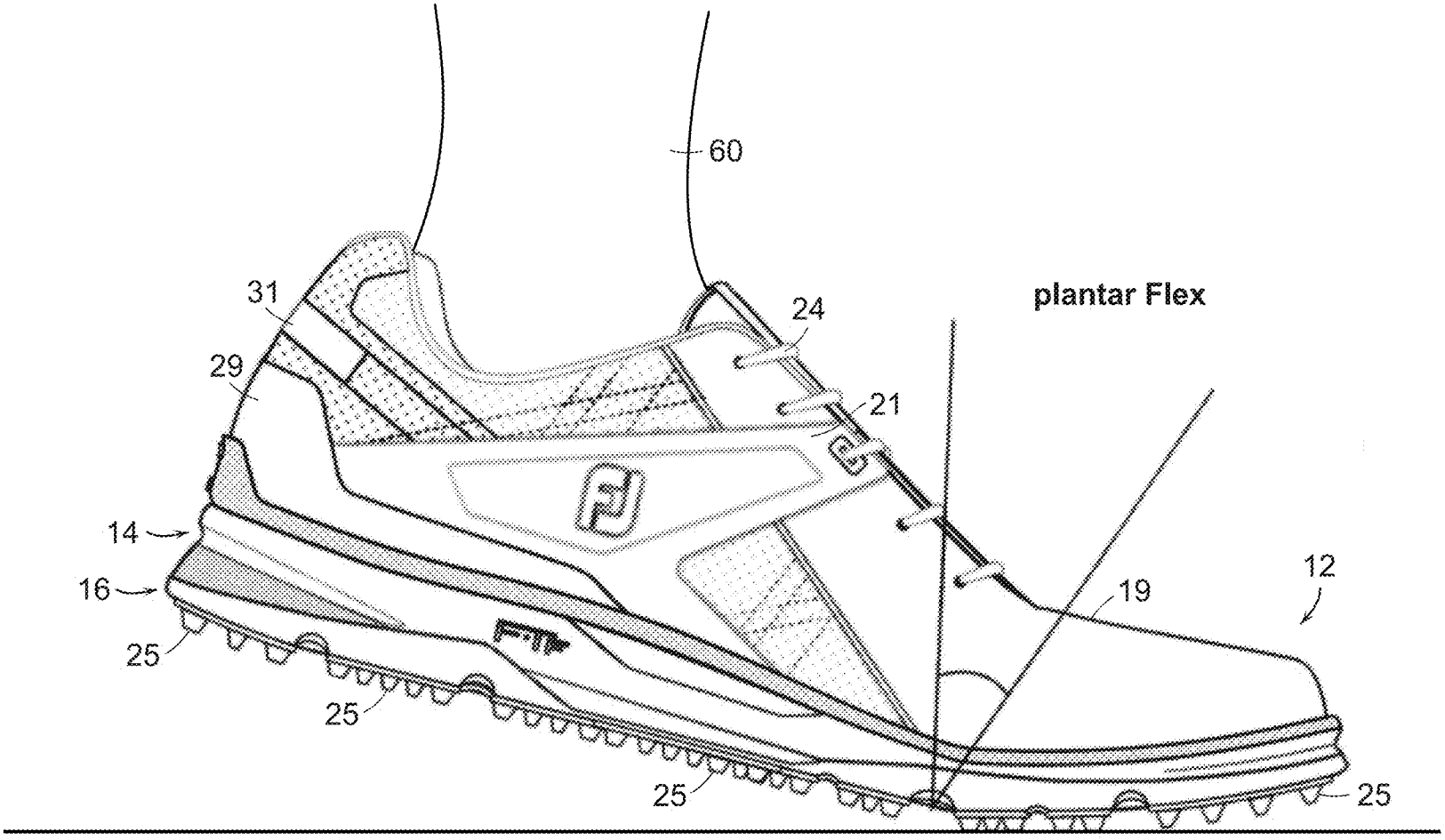
FIG. 8C is a lateral view of the golf shoe in FIG. 8A showing the forward portion of the outsole making contact with the ground surface as a person pushes off on his/her feet during a third stage of a person's walking cycle.

Turning to FIGS. 8A-8C, a normal walking cycle is schematically diagramed. Typically, when a person starts naturally walking, the outer part of his/her heel strikes the ground first with the foot (60) in a slightly supinated position. FIG. 8A shows one version of the golf shoe (10) of this invention (right foot) with the heel portion of the outsole (16) striking the ground surface first as the golfer starts his/her walking gait. As the person transfers his/her weight to the inside portion of the foot (60), the arch of the foot is flattened, and the foot is pressed downwardly. The foot (60) also starts to rolls slightly inwardly to a pronated position. In some instances, the foot (60) may roll inwardly to an excessive degree and this is type of gait is referred to as over-pronation. In other instances, the foot (60) does not roll inwardly to a sufficient degree and this is referred to as under-pronation. FIG. 8B shows the rearward and forward portion of the outsole (16) making contact with the ground surface. Normal foot pressure is applied downwardly and the foot (60) starts to move to a normal pronated position and this helps with shock absorption. After the foot (60) has reached this neutral position (FIG. 8B), the person pushes off on the ball of his/her foot and continues walking (FIG. 8C). At this point, the foot (60) also rolls slightly outwardly again. In FIG. 8C, the forward portion of the outsole (16) is shown making contact with the ground surface as the person pushes off his/her foot and begins their next step. The golf shoes (10) of this invention have good stability and yet they also provide good forefoot flexibility so the golfer can perform his/her natural walking actions easily and comfortably.

Mid-Foot Region

The midsole (14) of the shoe (10) of this invention has many benefits and advantageous features such as providing cushioning and support. When walking and playing golf, there are numerous and varied forces acting on the foot (60) and the different parts of the shoe (10). For example, downward and upward forces can act on the midsole (14) during a golf swing. The midsole (14) of this invention is able to provide consistent comfort and support when such forces are applied.

Like the forefoot region (40), the mid-foot region (42) also contains traction members (25) protruding from the bottom surface (27) of the outsole (16) to contact the ground. The mid-foot region (42) contains traction members (25) that help provide high surface area contact with the ground and prevent the outsole from slipping and sliding. In one preferred embodiment, the golf shoe (10) of this invention has five different traction members (25) extending along the forefoot, mid-foot, and rear-foot regions (40, 42, and 44) of the outsole (16), and these traction members are discussed in further detail below. Also, the mid-foot region (42) contains a foot bridge or shank that helps provide high stability and support and this is also discussed in further detail below.

Figure 9:
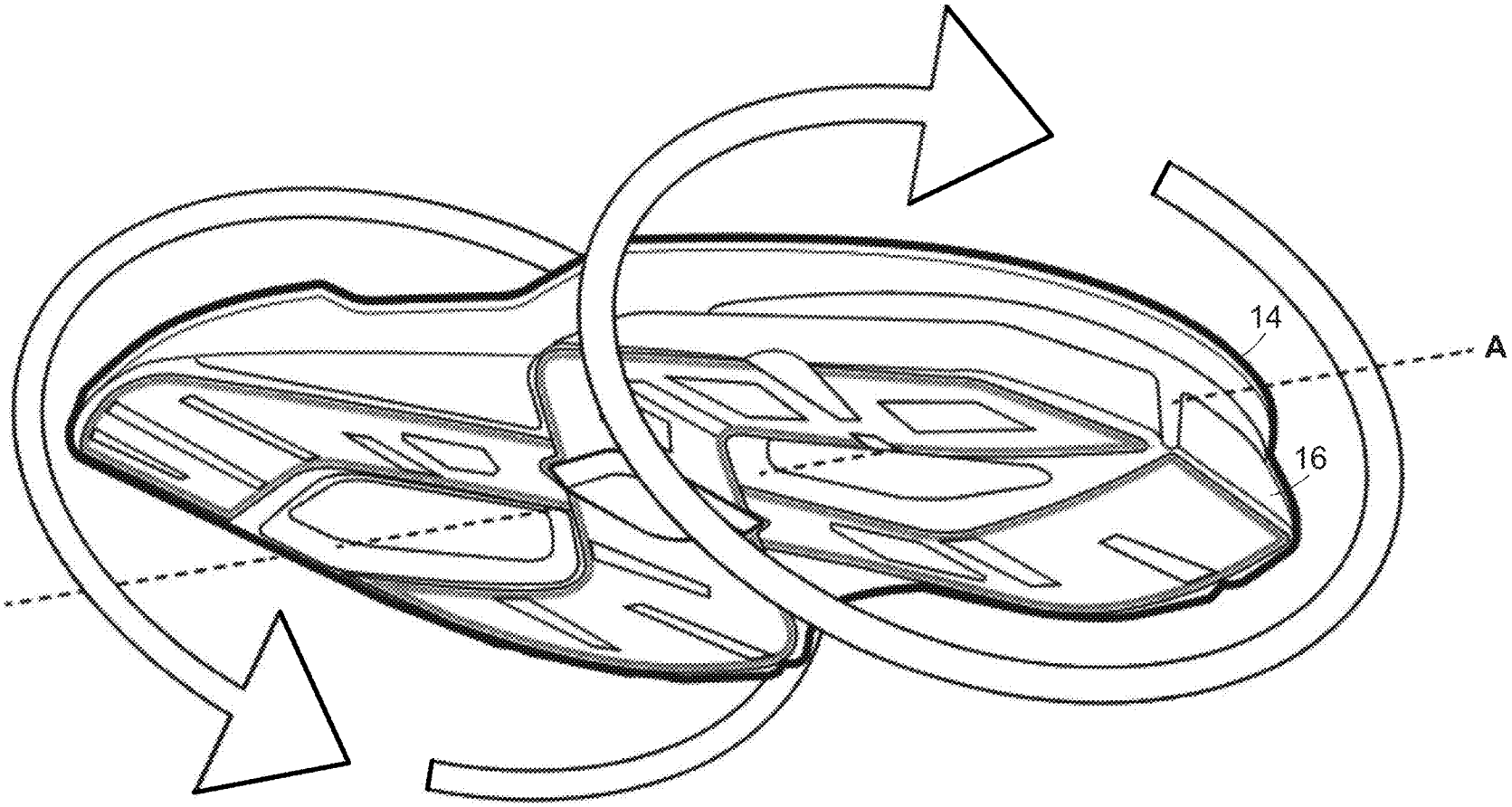
FIG. 9 is a schematic diagram of one example an outsole of the golf shoe of the present invention showing the twisting and turning of the midsole along Longitudinal Axis A.

As shown in FIG. 9, the golf shoes (10) of this invention have good torsional stability. That is, the mid-sole (14) and outsole (16) help provide the shoe (10) with high mechanical strength and structural integrity and do not allow excessive twisting or turning of the mid-foot region (42) along Longitudinal Axis A. The shoe (10) helps provide a stable platform for the golfer which is particularly important when the golfer is taking his/her swing and striking the ball.

During golf, the golfer will often need to place his feet on non-level surfaces such as surfaces littered with rocks, sticks, and other debris. This rough terrain can create hard forces on the foot and create an unstable platform for the golfer. This instability is particularly a problem difficult when the golfer needs to address the ball and make a shot. Also, these continuous stresses can cause ligaments, tendons, and muscles in the foot to feel sore and even sprain or tear. The golf shoes (10) of the present invention help address these problems with their improved stability and support of the foot. The shoe (10) helps provide a stable platform so the golfer can address the ball and make his/her swing. The shoe (10) provides this stable platform by resisting bending in the plantar flex direction. At the same time, the shoe (10) has good forefoot flexibility and allows for bending in the dorsal flex direction. Thus, the shoes of this invention provide a stable platform without sacrificing flexibility. Thus, the golfer can perform his/her swing on all types of golf course terrain including surfaces having rough and non-level surfaces as discussed in more detail below. At the same time, the shoes have good forefoot flexibility and provide full support allowing the golfer to walk with his/her natural gait and feel comfortable doing so.

Referring to FIGS. 10A-10E, the high stability and traction of the golf shoes (10) of this invention are shown in more detail in schematic illustrations. In FIG. 10A, a golfer is shown wearing the golf shoes (10) of this invention on terrain having a level surface such as, for example, a fairway on a golf course. Generally, the fairway is an area on the golf course having grass that is cut very short and it runs between the tee box and putting green. The shoe of this invention provides the golfer with high stability and support on fairways and other substantially level surfaces. Next, in FIGS. 10B and 10C, the golfer is shown wearing conventional golf shoes (65) on terrain having a non-level surface such as, for example, a rough on a golf course. Generally, the rough is an area on the golf course having higher and thicker grass. The non-mowed, high grass is outside the boundaries of the fairway. Often, the rough contains naturally growing and wild vegetation. These conventional shoes (65) tend to not provide high stability and support on the rough with its substantially non-level surfaces. Rather, as shown in more detail in FIG. 10C, these traditional shoes (65) tend to bend in a concave manner. This concave bending flex is a problem, because it produces vertical rear-foot motion during loading and unloading of the golf swing. Turning next to FIGS. 10D and 10E, the golfer is shown wearing the golf shoes (10) of this invention on the same non-level rough as shown in FIGS. 10A and 10B. In this example, however, the golf shoes (10) of this invention provide high stability and support on this substantially non-level surface. As shown in more detail in FIG. 10E, there is no concave bending flex of the shoe (10) when the golfer is standing on this uneven and rough terrain. This is in contrast to the concave flex that tends to occur in conventional shoes (65) as shown in FIG. 10C. As opposed to such conventional shoes (65), the golf shoes (10) of this invention provide a firm and stable platform for the golfer. The golf shoes (10) provide good support of the foot. The unique construction of these shoes (10) allows the golfer to make his/her swing with minimal or no rear-foot motion during loading and unloading of the swing.

Rear-Foot Region

Like the forefoot (40) and mid-foot (42) regions, the rear-foot region (44) also contains traction members (25) protruding from the bottom surface (27) of the outsole (16) to contact the ground. The rear-foot region (44) is relatively wide. This relatively large width, particularly in the heel area, further helps provide the shoe (10) with good stability. The rear-foot region (44) contains traction members (25) that provide high surface area contact with the ground and helps prevent the outsole from slipping and sliding. Maximum contact by the traction members (25) is maintained in the rear-foot region (44) as well as in the forefoot (40) and mid-foot (42) regions as discussed above. The different traction members (25) provide golf-specific traction, that is, these traction members help control forefoot, mid-foot, and rear-foot lateral traction, and prevent the foot from slipping and sliding as the golfer is walking and playing the course.

Traction Members

Figure 11:
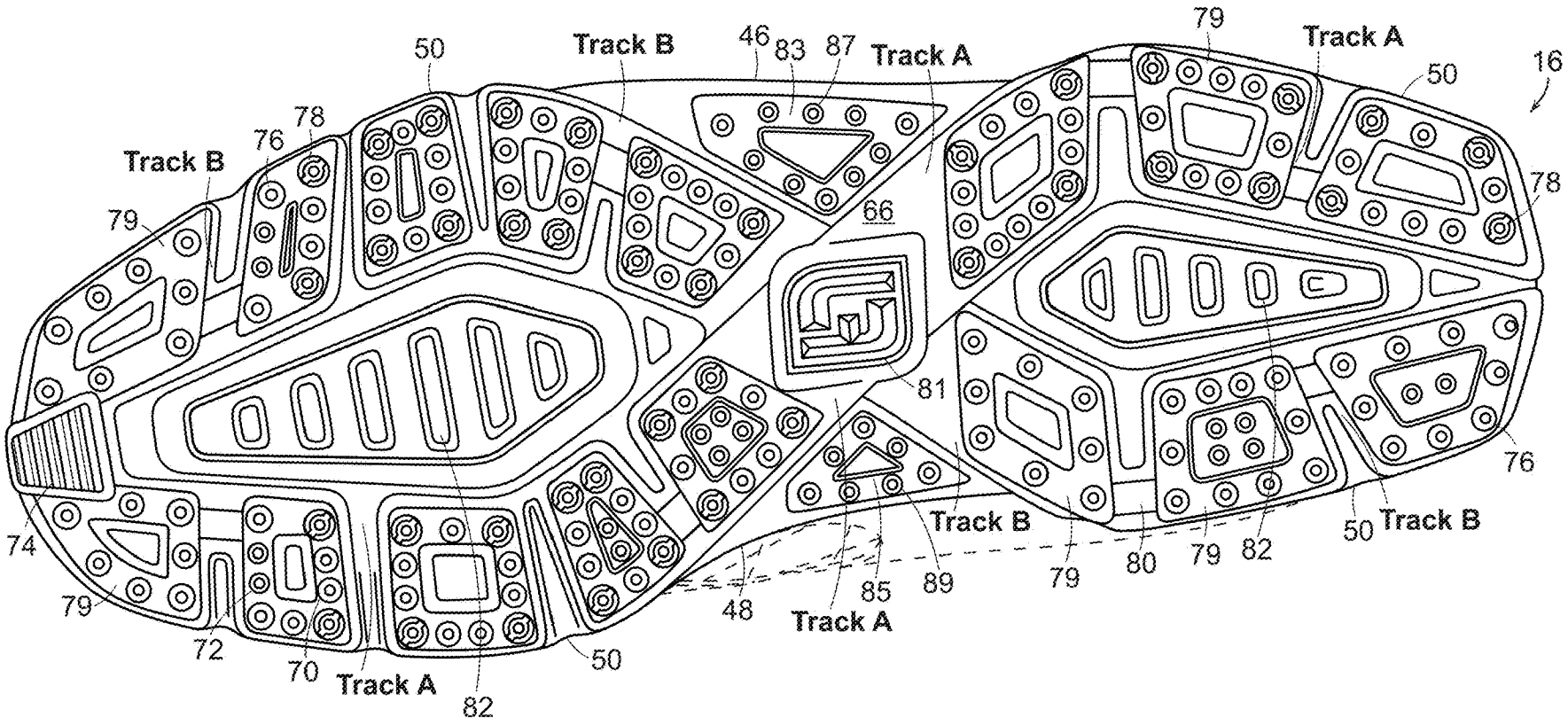
FIG. 11 is a bottom plan view of one example of a golf shoe of the present invention showing the traction members in detail.

Turning to FIG. 11, one preferred embodiment of the set of traction members (25) on the outsole (16) is shown in more detail. A first set of traction members are mounted on Track A which extends from the periphery (50) of the medial side (48) of the forefoot (40) and through the mid-foot (42) regions to the periphery (50) of the lateral side (46) of the rear-foot region (44). A second set of traction members are mounted on Track B which extends from the periphery (50) of the lateral side (46) of the forefoot (40) and through the mid-foot (42) regions to the periphery (50) of the medial side (48) of the rear-foot region (44).

The first set of traction members disposed on Track A can project outwardly from a plurality of first traction member bases that are fastened to Track A. The second set of traction members disposed on Track B can project outwardly from a plurality of first traction member bases that are fastened to Track B. The traction members can have various shapes and dimensions, for example, traction members (70, 72, 74, 76, and 78) can be used as described in further detail below. The traction members and their supporting bases (79) are preferably made of a relatively hard material such as thermoplastic polyurethane or a polyamide composition. The respective traction member supporting bases (79) can be fastened to Tracks A and B by stitching, adhesives, or any other suitable fastening means. The traction members and their respective bases can have various shapes such as, for example, annular, rectangular, triangular, square, spherical, elliptical, star, diamond, pyramid, arrow, conical, blade-like, and rod shapes. The traction members of Track A and the traction members of Track B can have the same or different shapes. In one preferred embodiment, at least a portion of the traction members of Track A and at least a portion of the traction members of Track B have conical shapes. Tracks A and B are preferably formed from the material used to make the midsole such as, for example, EVA or polyurethane foam compositions as discussed above.

Thus, the Tracks A and B criss-cross each other in the mid-foot region (42). When the Tracks A and B cross-over each other and form an X-shaped pattern, they provide the outsole (16) with a geometry that resembles the mathematical symbol for infinity (∞). The Tracks A and B generally have a width of about 2 to about 6 mm. The width of the Tracks may vary along the contour of the outsole (16) and change from the forefoot to mid-foot to rear-foot regions (40, 42, and 44).

The Tracks A and B form an X-shaped pattern in the mid-foot region (42). This X-shaped structure and infinity (o) geometry helps to provide greater bending stiffness in the shank (footbridge) (66) for the shoe outsole (16). This precise geometric structure also helps provide the shoes (10) with good torsional stability. This infinity (o) geometry and X-shaped structure (66) in the mid-foot region helps provide the shoe (10) with high mechanical strength and structural integrity and do not allow excessive twisting or turning of the shoe. The X-shaped footbridge (66) forms a bridge between the forefoot and rear-foot regions (40, 44) and helps support the mid-foot region (42). Also, in a preferred embodiment, mid-foot stability traction pieces (83, 85) are respectively positioned on the lateral (46) and medial (48) peripheral sides of the mid-foot region (42) and are adjacent to the footbridge (66). The mid-foot stability traction pieces (83, 85) are not positioned on Tracks A and B; rather, these stability traction pieces (83, 85) are disposed on the outsole between Tracks A and B. A third set of traction members (87) project outwardly from the first traction piece (83), and a fourth set of traction members (89) project outwardly from the second traction piece (85). These stability traction pieces (83, 85) and their respective protruding traction members (87, 89) further help provide torsional stability. These stability traction pieces (83, 85) and traction members (87, 89) help provide rigidity to the shoe without sacrificing shoe forefoot flexibility.

In the center of the X-shaped footbridge (66), a logo (81) may be placed. One preferred material for forming the visible logo (81) is thermoplastic polyurethane. The logo (81) may be covered and protected by a transparent polyurethane film. The strengthened shank (footbridge) (66) helps impart rigidity and structural support to the outsole. In turn, this outsole (16), with its high mechanical strength properties, gives the golfer more stability and balance while walking and playing the course.

As noted above, the traction members on the outsole (16) can have many different shapes including for example, but not limited to, annular, rectangular, triangular, square, spherical, elliptical, star, diamond, pyramid, arrow, conical, blade-like, and rod shapes. Also, the height and area of the traction members can vary. In the embodiment of the outsole shown in FIG. 2, these traction members include a Type 1 traction member (70) having a conical structure that can be referred to as a "medium-sized cone." The Type 2 traction member (72) also has a conical structure and can be referred to as a "small-sized cone." The Type 3 traction member (74) has a herringbone structure and can be referred to as a "herringbone." The Type 4 traction member (76) has a conical shape and can be referred to as a "pivot cone." The Type 5 traction member (78) also has a conical structure and can be referred to as a "locking cone." The traction members (70, 72, 74, 76, and 78) and their supporting bases (79) are preferably made of a relatively hard material such as thermoplastic polyurethane. Also, as shown in FIG. 11, the golf shoe contains a thermoplastic polyurethane bridge (80) connecting the traction member bases (79). The outsole (16) also can contain stability ridges (82) in its central area. These stability ridges (82) are not positioned on Tracks A and B; rather, they are disposed between Tracks A and B. The outsole (16) in the shoe of this invention has a greater number of traction members (25) as opposed to many conventional golf shoes and this large volume of traction members helps provide high traction and good ground contact. In addition, as discussed above, the outsole (16) has a wider heel area versus many conventional golf shoes and this feature helps provide high stability.

Furthermore, as discussed above and shown in FIGS. 3-7, the lower region (30) of the midsole (14) is preferably made of a relatively hard material such as a second foamed EVA composition with high durometer. This lower region (30) of the midsole (14) forms the sidewalls of the midsole (14) and these firm, strong sidewalls help hold and support the medial and lateral sides of the golfer's foot as they shift their weight when making a golf shot. This build-up of material in the lower region (30) also helps support the mid-foot region (42), where the X-shaped footbridge (66) structure is located.

The resulting shoe (10) has an optimum combination of structural rigidity and flexibility. A golfer wearing the shoe can comfortably walk and play the course. The golfer does not need to spend excessive time and energy on adjusting their shoes, which can occur with some conventional shoes. This fiddling of the shoes can lead to golfer fatigue and negatively affect playing performance on the golf course. Rather, the golf shoe (10) of this invention can be worn freely and naturally. The shoe (10) has high forefoot flexibility, and yet it does not sacrifice stability, traction, and other important properties as discussed above. The unique geometry and structure of the upper (12), midsole (14), and outsole (16) including the traction members (25) provides the golfer with a shoe having many beneficial properties.

It should be understood that the above-described shoe construction which generally includes: a) an upper (12); b) an outsole (16) having five different traction members; and c) a midsole (14) connecting the upper (12) and outsole (16), wherein the midsole comprises i) an upper region formed from a first material; and ii) a lower region formed from a second material such that the material hardness of the second material is greater than the material hardness of the first material, represents only one example of a shoe construction of this invention.

As discussed above, the unique midsole (14) structure made from two different materials such as, two foamed EVA materials, helps provide the golfer with high stability and balance on various surfaces. However, it is recognized that other midsole and shoe structures can be used without departing from the spirit and scope of the present invention.

Figure 12:
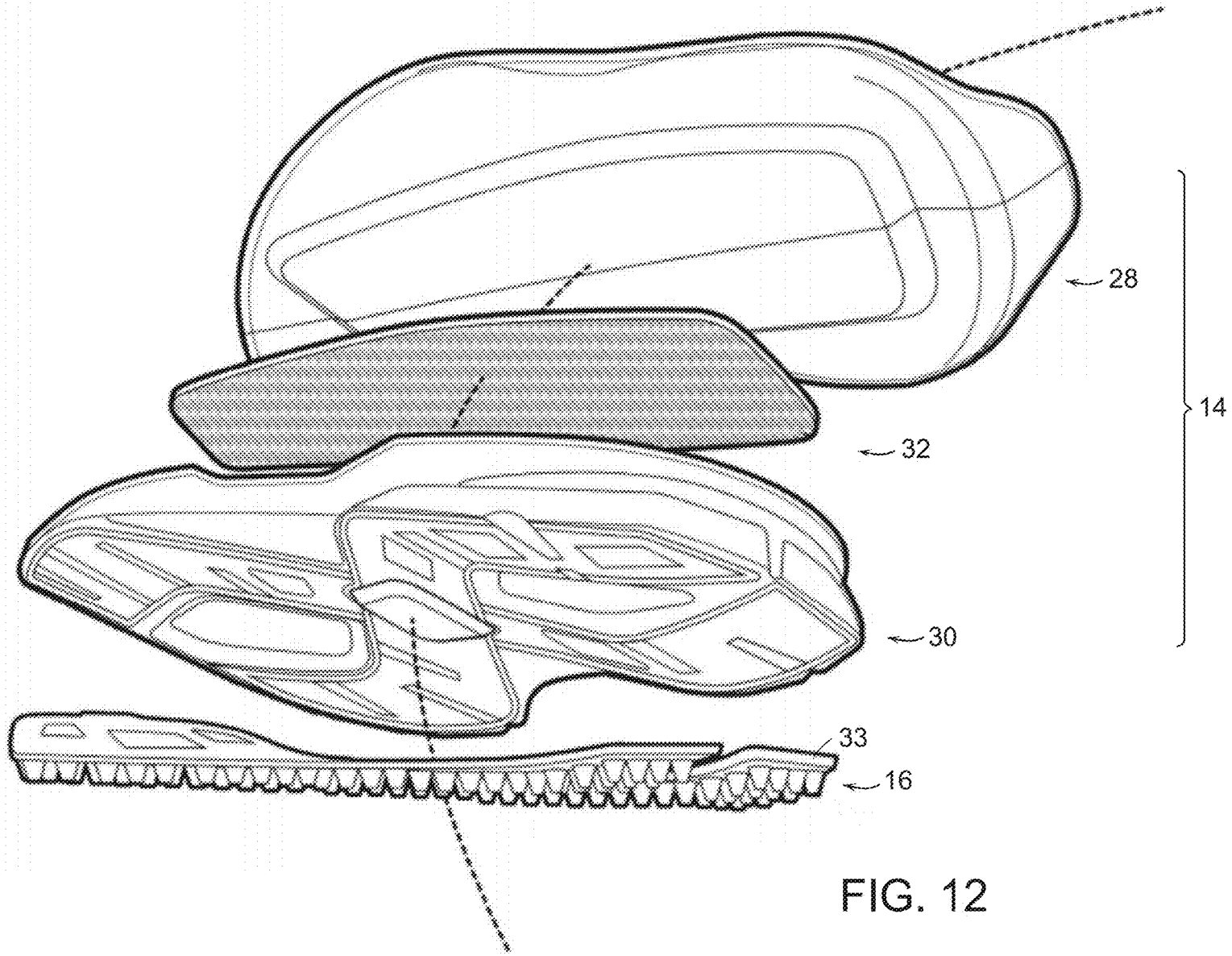
FIG. 12 is an exploded view of another example of a midsole and outsole of the golf shoe of the present invention showing a fiber-reinforced composite plate disposed in the midsole.

For example, in another embodiment of the midsole construction, a fiber-reinforced composite plate is disposed in the midsole. More particularly, as shown in the exploded view of FIG. 12, in this example, the midsole contains a fiber-reinforced composite plate (32) disposed between the upper and lower regions (28, 30) of the midsole (14). This example of the shoe (10) containing the fiber-reinforced composite plate (32) has relatively more structural rigidity than the shoe example described above. However, all of the embodiments of the shoe (10) of this invention provided high stability and traction. The shoes of this invention are able to hold and support the medial and lateral sides of the golfer's foot as they shift their weight while making a golf shot. The shoes help provide the golfer with a stable platform so that he/she can keep their balance when making shots on the course. The shoes provide high structural support to the golfer, and yet they do not sacrifice flexibility, traction, and other golf-performance properties. Thus, the golfer can walk and play the course and engage in other golf activities comfortably.

The different embodiments of the golf shoes of this invention provide both a high level of stability and traction as well as a high level of forefoot flexibility. The shoe provides stability and traction so there is no slipping and the golfer can stay balanced as he/she swings the club. At the same time, the shoe has good flexibility so the golfer is able to walk and play the course and engage in other golf activities comfortably. Referring back to FIGS. 9 and 10A-10E, the high stability and traction of the golf shoes (10) of this invention are illustrated.

For example, referring to FIGS. 13 through 19C, another embodiment of the midsole construction for the golf shoe of this invention is shown. This version of the midsole (14) differs from the midsole construction that is discussed above, because it further contains a fiber-reinforced composite plate (32) disposed between the upper (28) and lower (30) regions. This midsole laminate construction including the fiber-reinforced composite plate (32) is discussed in further detail below. The golf shoe (10) containing the fiber-reinforced composite plate (32) in this embodiment has relatively more structural rigidity than the above-described shoe that does not contain the composite plate (32). This composite plate shoe (10) helps provide the golfer with a stable platform so that he/she can keep their balance when making shots on the course. The shoe (10) provides high structural support to the golfer, and yet it does not sacrifice flexibility, traction, and other golf-performance properties.

For example, during normal golf play, a golfer makes shots with a wide variety of clubs. As the golfer swings a club when making a shot and transfers their weight, the foot absorbs tremendous forces. In many cases, when a right-handed golfer is addressing the ball, their right and left feet are in a neutral position. As the golfer makes their back-swing, the right foot presses down on the medial forefoot and heel regions, and, as the right knee remains tucked in, the right foot creates torque with the ground to resist external foot rotation. Following through on a shot, the golfer's left shoe rolls from the medial side (inside) of their left foot toward the lateral side (outside) of the left foot. Meanwhile, their right shoe simultaneously flexes to the forefoot and internally rotates as the heel lifts.

This embodiment of the shoe (10) containing the fiber-reinforced composite plate (32) helps provide high stability and traction. The shoe (10) is able to hold and support the medial and lateral sides of the golfer's foot as they shift their weight while making a golf shot. Thus, the golfer can stay balanced as he/she follows through the complete swinging motion of the club. More particularly, the fiber-reinforced composite plate (32) helps to provide greater bending stiffness in the shank (footbridge) (66). The composite fiber plate (32) helps provide the shoe (10) with high mechanical strength and structural integrity and do not allow excessive twisting or turning of the shoe. Thus, the shoe (10) has good torsional stability. At the same time, the shoe (10) has good forefoot flexibility so the golfer is able to walk and play the course and engage in other golf activities comfortably. There are several elements in this version of the golf shoe that help impart a high level of stability and traction as well as high flexibility.

Figure 13:
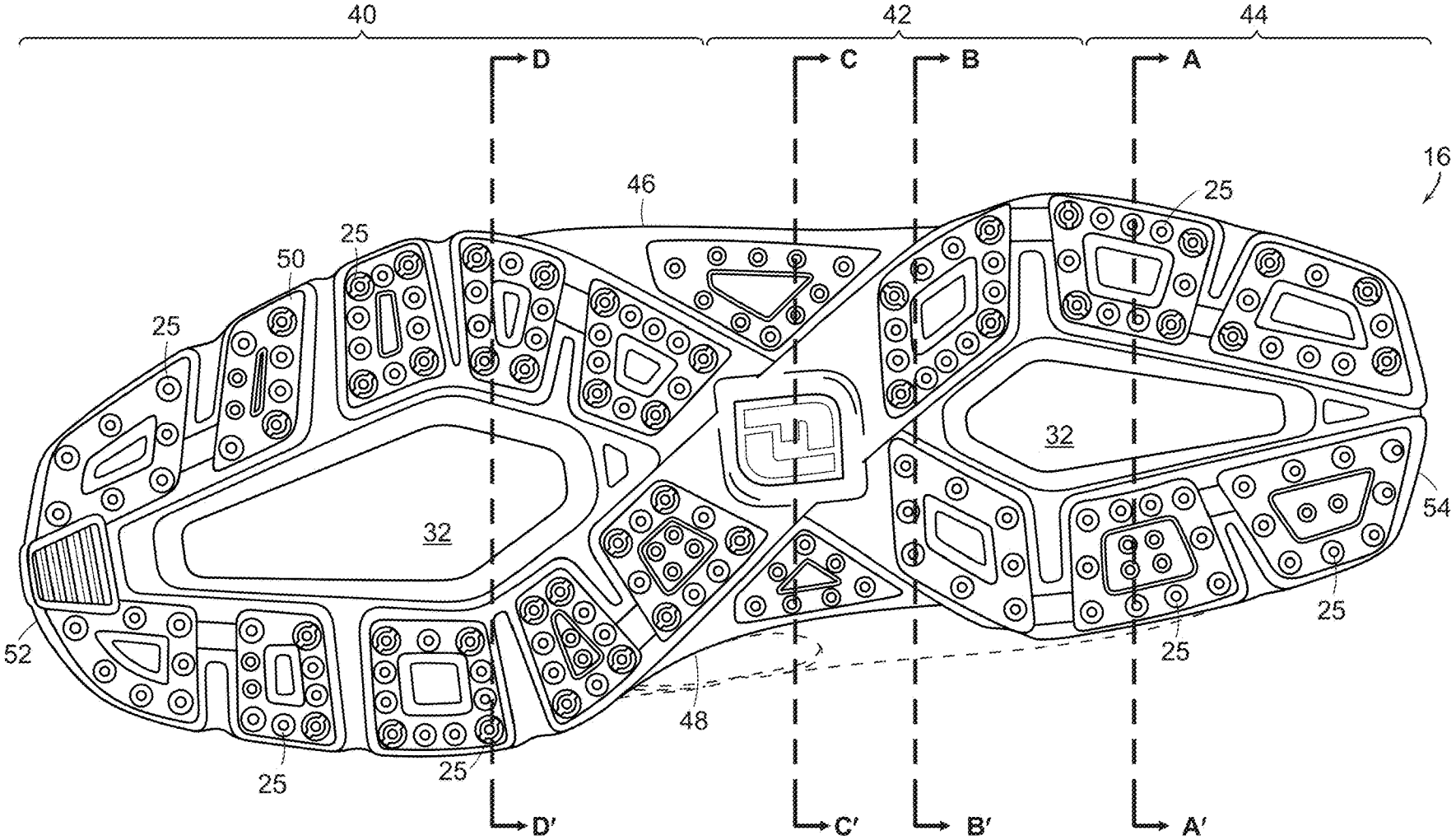
FIG. 13 is a bottom plan view of another example of a golf shoe of the present invention showing the outsole portion in detail.
Figure 14:
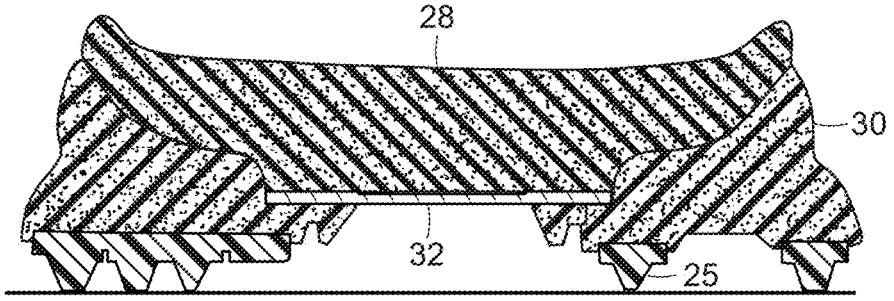
FIG. 14 is a cross-sectional view of the golf shoe shown in FIG. 13 along Line A-A'.
Figure 15:
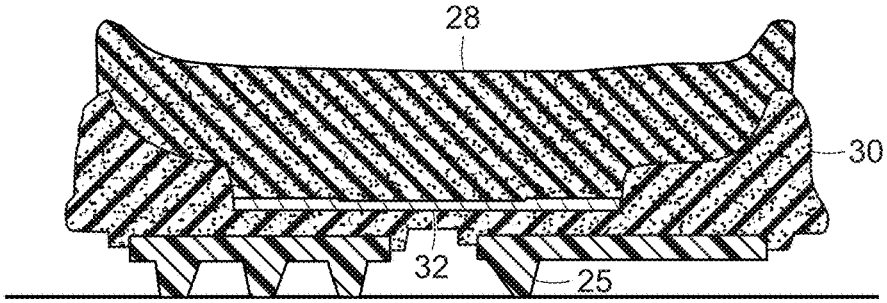
FIG. 15 is a cross-sectional view of the golf shoe shown in FIG. 13 along Line B-B'.
Figure 16:
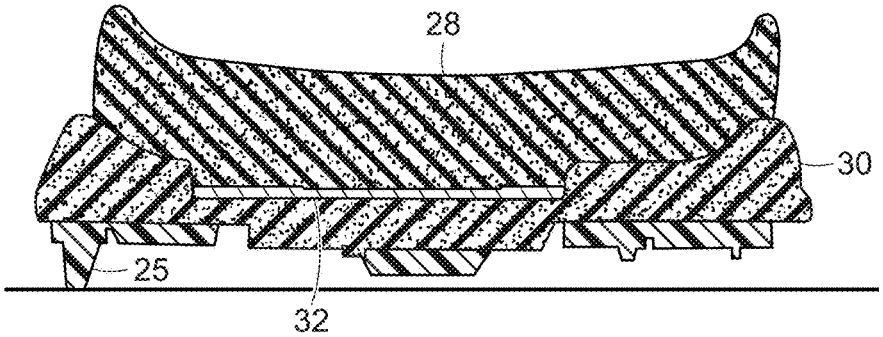
FIG. 16 is a cross-sectional view of the golf shoe shown in FIG. 13 along Line C-C'.
Figure 17:
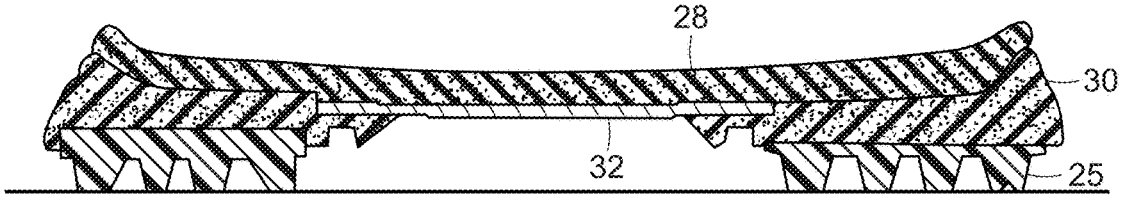
FIG. 17 is a cross-sectional view of the golf shoe shown in FIG. 13 along Line D-D'.
Figure 18:
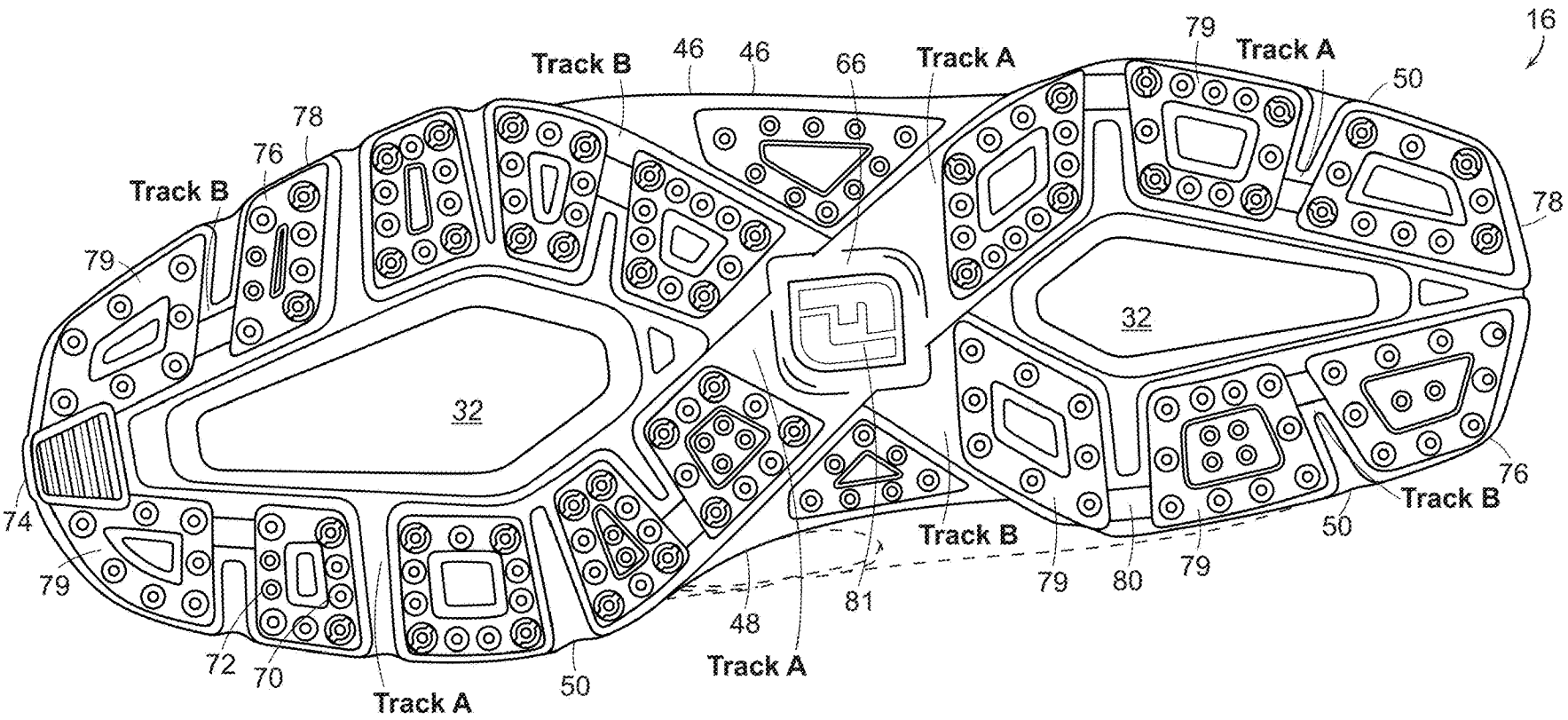
FIG. 18 is a bottom plan view of one example of a golf shoe of the present invention showing the traction members in detail.

First, as shown, in FIG. 13, the outsole in this shoe example also has an X-shaped structure as discussed above and this helps to provide high bending stiffness in the shank (footbridge) for the shoe outsole. The geometry and structure of the shank (footbridge) help impart rigidity and structural support to the outsole. That is, as shown in FIG. 18, the traction members are mounted on Track A which extends from the periphery of the medial side of the forefoot and through the mid-foot region to the periphery of the lateral side of the rear-foot region. The opposing traction members are mounted on Track B which extends from the periphery of the lateral side of the forefoot and through the mid-foot region to the periphery of the medial side of the rear-foot region. Thus, the Tracks A and B criss-cross each other in the mid-foot region. The Tracks A and B form an X-shaped pattern in the mid-foot region. This X-shaped structure and geometry helps to provide greater firmness in the shank (footbridge) for the shoe outsole. The X-shaped pattern forms a bridge between the forefoot and rear-foot regions and helps support the mid-foot region and provide greater bending stiffness. Also, in the embodiment of the outsole shown in FIG. 18, there are Type 1, Type 2, Type 3, Type 4, and Type 5 traction members as discussed above.

Secondly, as shown in FIGS. 14-17, the midsole of this embodiment of the shoe also is made using two different materials as also discussed above: for example, a relatively soft and flexible EVA foam and a relatively firm and rigid EVA foam and this helps support the mid-foot region, where the X-shaped structure of the mid-sole is located. The lower region (30) of the midsole forms the sidewalls of the midsole and these firm, strong sidewalls help hold and support the medial and lateral sides of the golfer's foot shoe as also discussed above.

Thirdly, referring back to the exploded view of FIG. 13 and as discussed above, this version of the midsole contains a fiber-reinforced composite plate (32) disposed between the upper and lower regions (28, 30) of the midsole (14). The positioning of the fiber-reinforced composite plate (32) in relation to the upper and lower regions (28, 30) of the midsole is discussed in more detail below.

The fiber-reinforced composite plate (32) comprises a binding matrix (resin) and reinforcing fiber. The binding polymer can be a thermoset material such as epoxy or rubber. Thermoplastic resins such as polyesters, polyolefins, nylons, and polyurethanes also can be used. Preferably, carbon fiber such as graphite is used as the reinforcing fibers. Other fibers such as aramids (for example, Kevlar™), aluminum, or glass fibers can be used in addition to or in place of the carbon fibers. The fiber-reinforced composite plate can be manufactured using standard techniques, where the reinforcing fibers are impregnated with a resinous material, such as epoxy. This resin is used as a matrix to bind the reinforcement fibers. These impregnated materials may be laid-up to form a laminate structure such as a plate which is cured at high temperatures to solidify the composite material. The resulting fiber-reinforced composite plate is lightweight and has excellent mechanical properties such as high stiffness, high tensile strength, and a low weight-to-strength ratio. As discussed above, the midsole (14) has a sandwich-like or laminate construction, wherein the fiber-reinforced composite plate (32) is disposed between the relatively soft foam upper region (28) and relatively hard foam lower region (30).

Figure 19A:
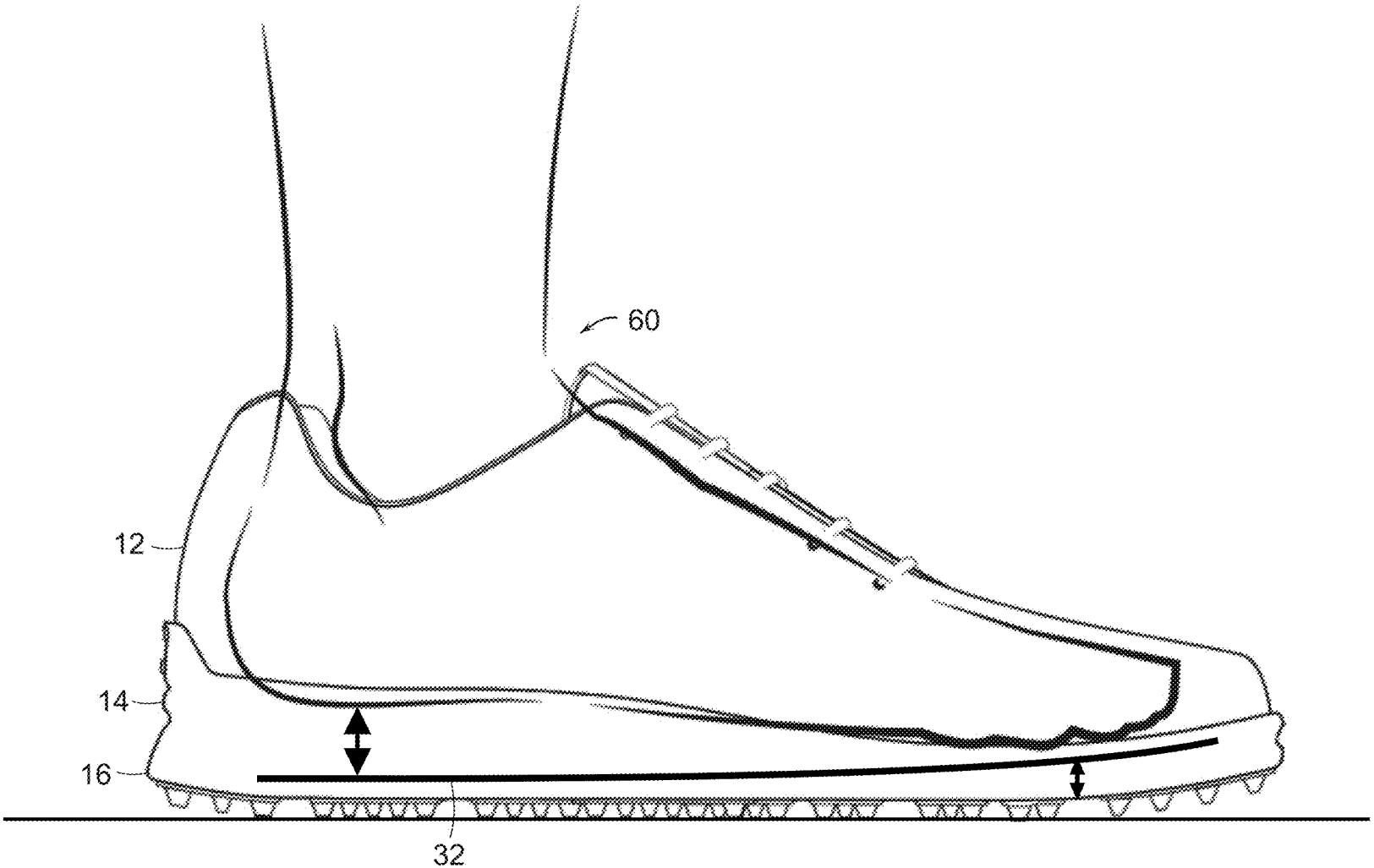
FIG. 19A is a schematic diagram of one example of the shoe of this invention showing the composite plate positioned in a first area of the shoe.
Figure 19B:
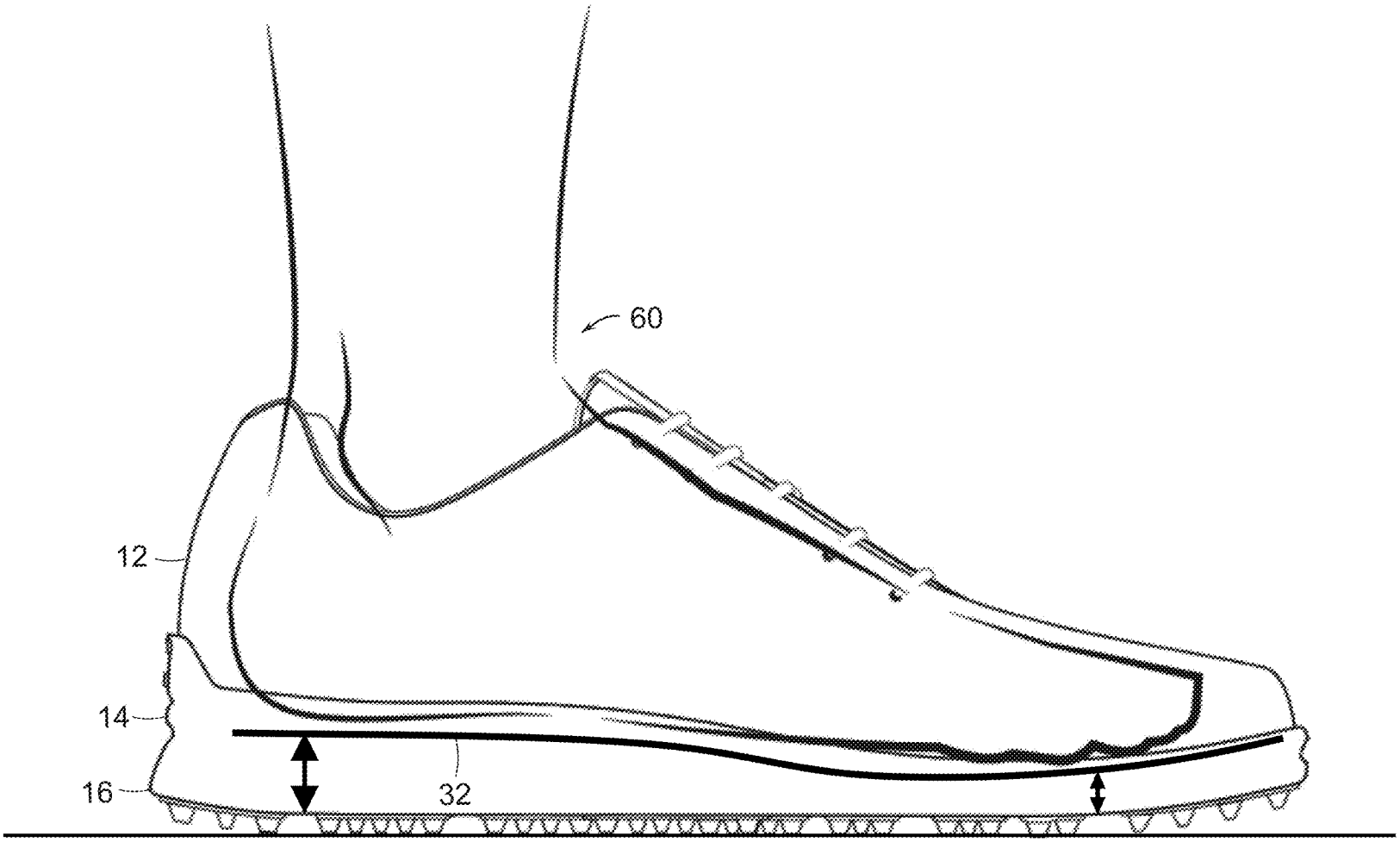
FIG. 19B is a schematic diagram of one example of the shoe of this invention showing the composite plate positioned in a second area of the shoe.
Figure 19C:
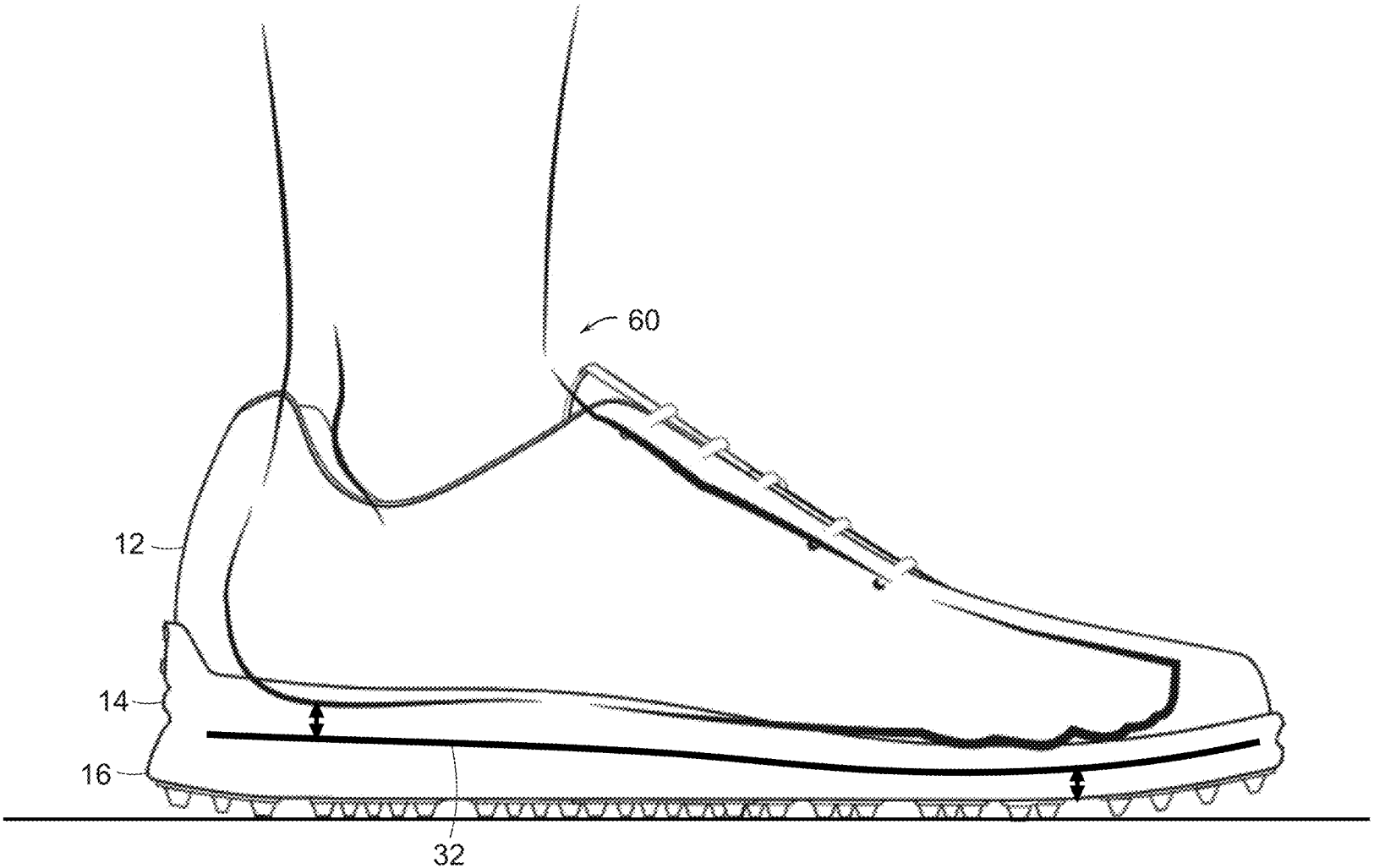
FIG. 19C is a schematic diagram of one example of the shoe of this invention showing the composite plate positioned in a third area of the shoe.

In FIGS. 19A-19C, the composite plate (32) is shown positioned so that it extends from the anterior end (52) to the posterior end (54) of the midsole (14). The foot (60) is shown positioned in the shoe (10). In one version, as shown in FIG. 19A, the composite plate (32) has one end (anterior) located in a relatively close position (for example, a distance in the range of about 2 to about 6 mm, and preferably about 4 mm) to the forefoot (62). Meanwhile, the composite plate (32) has an opposing second end (posterior) located in a relatively far position (for example, a distance in the range of about 12 to about 16 mm) to the rear-foot (64). That is, the composite plate (32) is located relatively far away from the ground in the forward portion of the shoe (10) and relatively close to the ground in the rear portion of the shoe. This positioning of the composite plate (32) in the shoe construction helps the shoe (10) provide a stable platform for the golfer. This placement of the composite plate (32) in the midsole (14) laminate structure helps the support the feet and gives the golfer improved balance.

In a second version, as shown in FIG. 19B, the composite plate (32) is shown positioned so that it extends from the anterior end (52) to the posterior end (54) of the midsole, and it is located essentially on the upper surface of the midsole construction (14). The first and second ends of the composite plate (32) are located close to the forefoot (62) and the rear-foot (64) regions, respectively of the midsole (14). That is, in this shoe construction, the composite plate (32) is located relatively far away from the ground in both the forefoot (62) and rear-foot (64) regions.

In a third version, as shown in FIG. 19C, the composite plate (32) is shown positioned so that it extends from the anterior end (52) to the posterior end (54) of the midsole, and it is essentially centered between the upper surface and lower surface of the midsole laminate construction (14). The composite plate (32) is located at approximately an equidistance between the forefoot region (62) and ground; and approximately an equidistance between the rear-foot (64) region and ground. The composite plate (32) has one end (anterior) located at a mid-distance to the forefoot (62).

Meanwhile, the composite plate (32) has an opposing second end (posterior) located at a mid-distance) to the rear-foot (64). That is, in this shoe construction, the composite plate (32) is located at an approximately central position in the midsole (14) laminate structure.

Figure 19D:
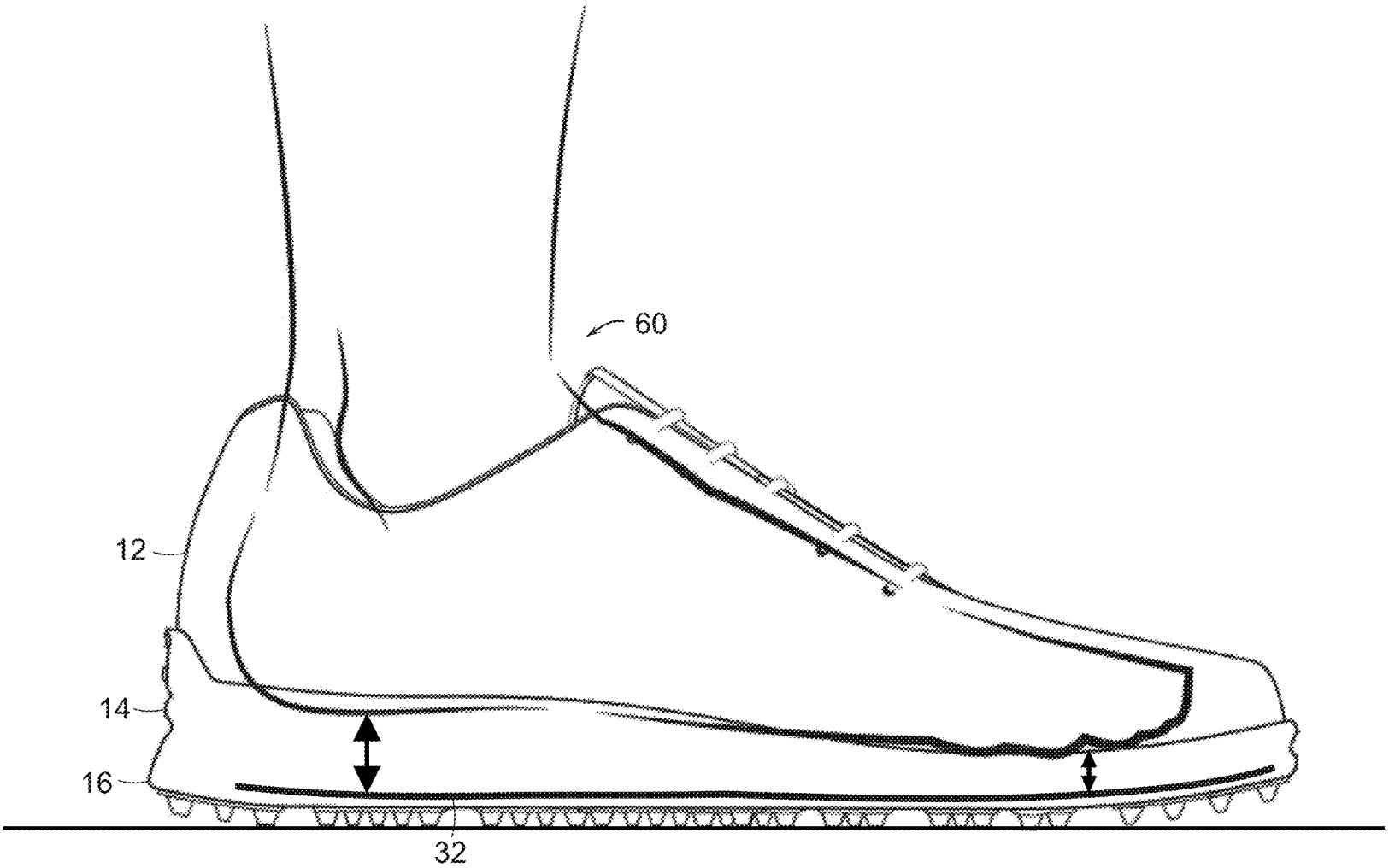
FIG. 19D is a schematic diagram of one example of the shoe of this invention showing the composite plate positioned in a fourth area of the shoe.

In a fourth version, as shown in FIG. 19D, the composite plate (32) is shown positioned so that it extends from the anterior end (52) to the posterior end (54) of the midsole, and it is located essentially on the lower surface of the midsole construction (14). The composite plate (32) is located far away from both the forefoot (62) and the rear-foot (64) of the midsole (14). That is, in this shoe construction, the composite plate (32) is located relatively close to the ground in both the forefoot (62) and rear-foot (64) regions.

The Moment of Inertia of the Area of the fiber-reinforced composite plate (32) also should be considered. In general, the moment of inertia of the area is a geometrical property which reflects how the area's points are distributed with regard to an arbitrary axis. The moment of inertia of the area is calculated with respect to a reference axis such as X or Y, that is normally a centroid or neutral axis. See, R. C. Hibbeler, *Statics,* $14^{th}$ ed. (Pearson Prentice Hall, Hoboken NJ 2016) pp. 528-531; and Editors of *Mechanical Design in Optical Engineering*, (optics.arizona.edu) pp. 32-36.

Figure 20:
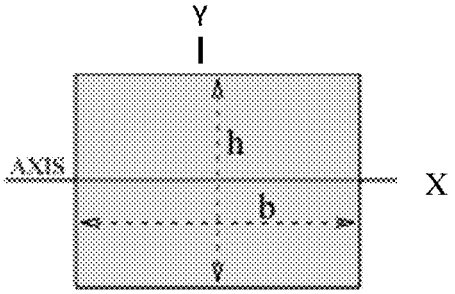
FIG. 20 is a schematic diagram of a rectangular cross-section showing how the moment of inertia for an area can be calculated.

For standard shapes, such as a rectangle as shown in FIG. 20, the moment of inertia of an area can be calculated by the formula:

$$I_x = \frac{BH^3}{12}$$

where, B is the base (horizontal) and H is the height (vertical) of the object.

In this example of a rectangular cross-section, the bending occurs about the X axis, which is a centroid axis.

Figure 21:
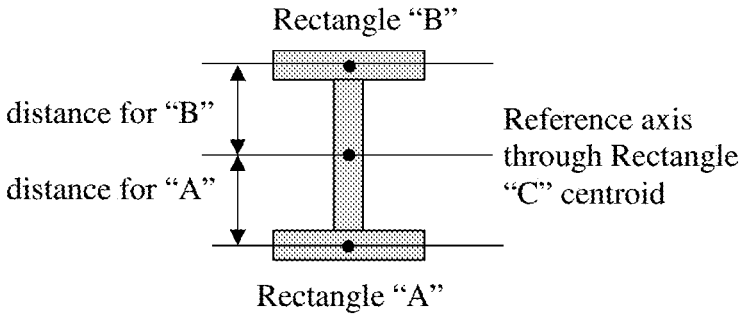
FIG. 21 is a schematic diagram of an I-Beam cross-section showing how the moment of inertia for an area can be calculated.

For more complex shapes having multiple cross-sectional areas such as an "I-Beam", as shown in FIG. 21, the parallel-axis theorem can be used to find the area moment of inertia. In these examples, the object is divided into multiple simple cross sectional areas. The parallel-axis theorem states the moment of inertia for an area about an axis is equal to its moment of inertia about a parallel axis passing through the area's centroid plus the product of the area and the square of the perpendicular distance between the axes. Using this theorem, the individual area moments of inertia for each of the three rectangular areas in the I-beam (Diagram II) can be calculated with respect to one common axis of bending and summated to determine the total area moment of inertia for the I-beam. The parallel axis theorem indicates that as the distance of an area from the bending axis increases, its contribution to the magnitude of the area moment of inertia also increases.

In the present invention, by moving the fiber-reinforced composite plate closer to or farther away from the natural bending axis of the foot, the inventors can substantially alter the area moment of inertia of the plate according to the parallel axis theorem. In other words, the inventors have found that they can control the bending resistance of the plate directionally by how they position the plate with respect to the flexion bending axis and the extension bending axis of the foot.

If the fiber-reinforced composite plate is positioned closer to the flexion bending axis of the foot, then the area moment of inertia is lowered and the plate is easier to bend. There is less bending-resistance. On the other hand, if the plate is positioned farther away from the flexion bending axis of the foot, then the area moment of inertia is increased and the plate is able to resist dorsal flexion to a greater extent.

Referring back to FIG. 19A, the inventors have positioned the composite plate in this example so that it is located at a relatively far distance from the foot in the rear-foot region; and at a relatively close distance to the foot in the forefoot region.

In this manner, the composite plate in FIG. 19A is disposed so that it has high bending-resistance in the heel region. Also, by placing the plate in the midsole so that it is located relatively far away from the heel, this area of the midsole is also able to provide more comfort and cushioning for the foot. In contrast, the composite plate in FIG. 19A is disposed in the midsole so that is very close to the foot in the forefoot region. In this manner, the plate has less bending-resistance in the forefoot region. Thus, a person can push off on the ball of his/her foot easily. This helps a person to walk more naturally and comfortably. The shoe feels less stiff in the forefoot region. The forward portion of the outsole makes solid contact with the ground surface as the person springs off his/her foot. Furthermore, by placing the plate in the midsole so that it located relatively close to the forefoot, there is less bending-resistance for golf specific actions such as when a person crouches down on their toes when lining-up a putt. The shoe is able to able to bend more easily in this forefoot area when the weight of the foot (load) acts on the plate versus when the weight of the foot acts on the plate in the heel area. The inventors have found that they can engineer the flex bias of the shoe by positioning the plate in different locations and precisely changing the vertical distance between the plate and foot.

All of the different embodiments of the golf shoes (10) of this invention provide both a high level of stability and traction as well as a high level of flexibility. The shoes provide stability and traction so there is no slipping and the golfer can stay balanced as he/she swings the club. At the same time, the shoes have good flexibility so the golfer is able to walk and play the course and engage in other golf activities comfortably. Referring back to FIGS. 11A-11E, the high stability and traction of the golf shoes of this invention on different surfaces are illustrated.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "top", "bottom", "upper", "lower", "downward", "right", "left", "middle" "proximal", "distal", "lateral", "medial", "anterior", "posterior", and the like are arbitrary terms used to refer to one position of an element based on one perspective and should not be construed as limiting the scope of the invention.

All patents, publications, test procedures, and other references cited herein, including priority documents, are fully incorporated by reference to the extent such disclosure is not inconsistent with this invention and for all jurisdictions in which such incorporation is permitted. It is understood that the shoe materials, designs, and structures; shoe components; and shoe assemblies and sub-assemblies described and illustrated herein represent only some embodiments of the invention. It is appreciated by those skilled in the art that various changes and additions can be made to such products and materials without departing from the spirit and scope of this invention. It is intended that all such embodiments be covered by the appended claims.

We claim:

1. A golf shoe comprising:

an upper;

an outsole;

and a midsole connected to the upper and outsole, the upper, midsole, and outsole each having forefoot, mid-foot, and rear-foot regions and lateral and medial sides; and the midsole comprising: i) an upper region formed from a first material and having an upper surface; ii) a lower region formed from a second material and having a lower surface; and iii) a fiber-reinforced composite plate disposed between the upper and lower regions, wherein a Shore C hardness of the second material is greater than a Shore C hardness of the first material, wherein the composite plate is positioned so that it has a first end in the forefoot region of the midsole and a second end in the rear-foot region of the midsole, wherein a forefoot distance from the first end of the composite plate to the lower surface of the midsole is substantially the same as a rear-foot distance from the second end of the composite plate to the upper surface of the midsole rear-foot region, wherein the outsole comprising a Track A containing a first set of traction members, and a Track B containing a second set of traction members, wherein Track A extends from a periphery of the medial side of the forefoot and through the mid-foot region to the periphery of the lateral side of the rear-foot region and Track B extends from the periphery of the lateral side of the forefoot and through the mid-foot region to the periphery of the medial side of the rear-foot region such that Tracks A and B criss-cross each other in the mid-foot region; wherein Track A has an outer edge and an inner edge and Track B has an outer edge and an inner edge such that one of Track A and Track B crosses over the other.

2. The golf shoe of claim 1, wherein the composite plate contains carbon fiber.

3. The golf shoe of claim 1, wherein the first material used to form the upper region of the midsole has a hardness in the range of about 40 to about 75 Shore C.

4. The golf shoe of claim 1, wherein the second material used to form the lower region of the midsole has a hardness in the range of about 45 to about 80 Shore C.

5. The golf shoe of claim 1, wherein a first ethylene vinyl acetate copolymer foam composition is used to form the upper region of the midsole, and a second ethylene vinyl acetate copolymer foam composition is used to form the lower region of the midsole.

6. The golf shoe of claim 1, wherein a first polyurethane foam composition is used to form the upper region of the midsole, and a second polyurethane foam composition is used to form the lower region of the midsole.

7. The golf shoe of claim 1, wherein Track A and Track B of the outsole are formed from foam compositions selected from the group consisting of foamed ethylene vinyl acetate copolymer and foamed thermoplastic polyurethane compositions.

8. The golf shoe of claim 7, wherein the traction members of Track A project outwardly from a plurality of first traction member bases, the first traction member bases being fastened to Track A; and the traction members of Track B project outwardly from a plurality of second traction member bases, the second traction member bases being fastened to Track B.

9. The golf shoe of claim 7, wherein the traction members of Tracks A and B are formed from thermoplastic polyurethane compositions.

10. The golf shoe of claim 7, wherein the traction members of Tracks A and B are formed from polyamide compositions.

11. The golf shoe of claim 1, wherein at least a portion of the traction members of Track A and at least a portion of the traction members of Track B have shapes selected from the group consisting of annular, rectangular, triangular, square, spherical, elliptical, star, diamond, pyramid, arrow, conical, blade-like, and rod shapes and combinations thereof.

12. The golf shoe of claim 11, wherein at least a portion of the traction members of Track A and at least a portion of the traction members of Track B have conical shapes.

13. The golf shoe of claim 11, wherein the traction members of Track A and the traction members of Track B have the same shapes.

14. The golf shoe of claim 11, wherein the traction members of Track A and the traction members of Track B have different shapes.

15. The golf shoe of claim 1, wherein the outsole further comprises first and second sets of stability traction ridges, the traction ridges being located in a central area between Track A and Track B, wherein the first set of traction ridges is located in the forefoot region and the second set of traction ridges is located in the rear-foot region.

16. The golf shoe of claim 15, wherein a third set of traction members project outwardly from a first mid-foot stability traction piece, and a fourth set of traction members project outwardly from a second mid-foot stability traction piece.

17. The golf shoe of claim 16, wherein the third and fourth sets of traction members are formed from thermoplastic polyurethane compositions.

* * * * *